US008881328B2

(12) United States Patent
Mikkelsen et al.

(10) Patent No.: US 8,881,328 B2
(45) Date of Patent: Nov. 11, 2014

(54) BODY SUPPORT WITH FLUID SYSTEM AND METHOD OF OPERATING SAME

(75) Inventors: Tom D. Mikkelsen, Kingsport, TN (US); Kelly W. Chandler, Gate City, VA (US)

(73) Assignee: Tempur-Pedic Management, LLC, Lexington, KY (US)

( * ) Notice: Subject to any disclaimer, the term of this patent is extended or adjusted under 35 U.S.C. 154(b) by 669 days.

(21) Appl. No.: 13/141,542

(22) PCT Filed: Dec. 18, 2009

(86) PCT No.: PCT/US2009/068814

§ 371 (c)(1),
(2), (4) Date: Aug. 17, 2011

(87) PCT Pub. No.: WO2010/075230

PCT Pub. Date: Jul. 1, 2010

(65) Prior Publication Data

US 2012/0017376 A1 Jan. 26, 2012

Related U.S. Application Data

(60) Provisional application No. 61/140,773, filed on Dec. 24, 2008, provisional application No. 61/139,957, filed on Dec. 22, 2008.

(51) Int. Cl.

| | |
|---|---|
| ***A47C 27/15*** | (2006.01) |
| ***A47C 27/14*** | (2006.01) |
| ***A47C 21/04*** | (2006.01) |

(52) U.S. Cl.

CPC ..... *A47C 21/044* (2013.01); *A47C 27/144* (2013.01); *A47C 27/15* (2013.01)

USPC ..... 5/726; 5/740; 5/423; 5/652.2

(58) Field of Classification Search

USPC ..... 5/724, 726, 652.1, 652.2, 423, 694, 5/730, 723, 740

See application file for complete search history.

(56) References Cited

U.S. PATENT DOCUMENTS

| | | | |
|---|---|---|---|
| 1,142,876 A | 6/1915 | Davis et al. | |
| 3,101,488 A | 8/1963 | Peebles | |

(Continued)

FOREIGN PATENT DOCUMENTS

| | | | |
|---|---|---|---|
| EP | 1997467 | 12/2008 | |
| GB | 2032269 A * | 5/1980 | ..... A47C 27/00 |

(Continued)

OTHER PUBLICATIONS

Amerigon Incorporated, "Amerigon Reports 2008 Third Quarter, Nine-Month Results," press release, Oct. 28, 2008, pp. 4-10, PR Newswire, Yahoo Inc.

(Continued)

*Primary Examiner* — Michael Trettel

(57) ABSTRACT

A body support assembly comprising a first layer (e.g., a visco-elastic foam) having a lower surface, and a second layer supporting the first layer and having an upper surface. One of the upper and lower surfaces is defined by a non-planar surface to define a plurality of passages. A fan is positioned to move air through the passages. Preferably, the non-planar surface comprises a plurality of protrusions (e.g., a convoluted surface). The body support can further comprise a sensor that detects a parameter and produces a signal, and a controller coupled to the sensor and programmed to control the fan. Multiple fans and sensors can be provided, and the controller can control the fans to provide different air flows through different locations of the body support assembly. A user interface can be coupled to the controller to allow selection of a desired parameter of the body support assembly.

18 Claims, 10 Drawing Sheets

(56) References Cited

U.S. PATENT DOCUMENTS

| | | | | |
|---|---|---|---|---|
| 3,266,064 | A | 8/1966 | Figman | |
| 3,529,310 | A | 9/1970 | Olmo | |
| 4,057,861 | A * | 11/1977 | Howorth | 5/726 |
| 4,580,301 | A | 4/1986 | Ludman et al. | |
| 4,825,488 | A * | 5/1989 | Bedford | 5/726 |
| 5,546,618 | A * | 8/1996 | Beedy et al. | 5/725 |
| 5,887,304 | A * | 3/1999 | von der Heyde | 5/726 |
| 6,336,237 | B1 | 1/2002 | Schmid | |
| 6,425,527 | B1 | 7/2002 | Smole | |
| 6,546,576 | B1 | 4/2003 | Lin | |
| 6,782,574 | B2 * | 8/2004 | Totton et al. | 5/713 |
| 6,866,915 | B2 * | 3/2005 | Landvik | 428/158 |
| 7,165,281 | B2 | 1/2007 | Larssson | |
| 7,240,386 | B1 | 7/2007 | McKay et al. | |
| 7,334,280 | B1 * | 2/2008 | Swartzburg et al. | 5/724 |
| 7,469,437 | B2 * | 12/2008 | Mikkelsen et al. | 5/740 |
| 7,520,012 | B2 * | 4/2009 | Robins | 5/740 |
| 7,975,331 | B2 * | 7/2011 | Flocard et al. | 5/423 |
| 2003/0019044 | A1 | 1/2003 | Larsson et al. | |
| 2007/0056116 | A1 * | 3/2007 | Galardo | 5/724 |
| 2008/0263776 | A1 * | 10/2008 | O'Reagan et al. | 5/714 |

FOREIGN PATENT DOCUMENTS

| | | |
|---|---|---|
| JP | 55-34463 | 8/1953 |
| JP | 06-022829 | 1/1994 |
| JP | 6022829 | 2/1994 |
| JP | 07-313306 | 12/1995 |
| JP | 2003-024184 | 1/2003 |
| JP | 2006-014819 | 1/2006 |
| WO | 2005120295 | 12/2005 |

OTHER PUBLICATIONS

PCT/US2009/068814 International Search Report, Jun. 2010.

* cited by examiner

BODY SUPPORT WITH FLUID SYSTEM AND METHOD OF OPERATING SAME

CROSS-REFERENCE TO RELATED APPLICATIONS

Priority is hereby claimed to U.S. Provisional Patent App. No. 61/139,957, filed Dec. 22, 2008, and U.S. Provisional Patent App. No. 61/140,773, filed Dec. 24, 2008, the entire contents of both of which are herein incorporated by reference.

FIELD OF THE INVENTION

Conventional body supports are found in a wide variety of shapes and sizes, each of which is adapted for supporting one or more body parts of a user. As used herein, the term "body support" includes without limitation any deformable element or structure adapted to support one or more parts of (or the entire body of) a human or animal in one or more positions. Examples of body supports include but are not limited to mattresses, pillows, and cushions of any type, including those for use in beds, sleeper sofas, seats, and other applications.

Body supports are often constructed entirely or partially out of foam material. For example, polyurethane foam is commonly used in many mattresses, pillows, and cushions, and can be used alone or in combination with other types of cushion materials. In many body supports, visco-elastic material is used, providing the body support with an increased ability to conform to a user and to thereby distribute the weight or other load of the user. Some visco-elastic body support materials are also temperature sensitive, thereby also enabling the body support to change firmness based at least in part upon the temperature of the body part(s) supported thereon.

Although the number and types of body supports constructed with one or more layers of foam continue to increase, including one or more layers of foam comprising visco-elastic foam, the capabilities of such materials are often underutilized. In many cases, this underutilization is due to poor body support design and/or the choice of material(s) used in the body support. Some design issues that remain in many body supports include the lack of control over the temperature of the body support, the sleeping surface of the body support, and the environment immediately surrounding the sleeping surface, resulting in user discomfort under some sleeping conditions (e.g., relatively high humidity and/or temperature of the environment immediately surrounding the sleeping surface).

In many cases, it is desirable to regulate the temperature, humidity, and other characteristics of body supports, typically with the goal of increasing the comfort of the individuals who will use the body supports. Although many solutions exist to regulate these characteristics, design challenges still exist, including the ability to easily install systems and devices adapted to perform these functions, the need to produce and service such systems and devices at a reasonable cost, and the ability of such systems and devices to effectively and efficiently perform their intended functions.

Despite the increasing number and variety of devices and systems developed to regulate the temperature, humidity, and other characteristics of body supports, the design challenges that still exist call for continued development of this technology.

Based at least in part upon the limitations of existing body supports and the high consumer demand for improved body supports in a wide variety of applications, new body supports continue to be welcome additions to the art.

SUMMARY OF THE INVENTION

The invention provides a body support assembly comprising a first layer (e.g., a visco-elastic foam) having a lower surface, and a second layer supporting the first layer and having an upper surface in facing relation to the lower surface. At least one of the upper and lower surfaces is at least partially defined by a non-planar surface to thereby define a plurality of passages between the first and second layers. A fan is positioned (e.g., in a cavity in at least one layer) to move air through the passages. In one embodiment, only one of the upper and lower surfaces is at least partially defined by the non-planar surface, and the other of the upper and lower surfaces is substantially planar. Preferably, the non-planar surface comprises a plurality of protrusions (e.g., a convoluted surface).

If desired, a height of the passages varies along the length of the layers to thereby define restrictions. In this embodiment, the assembly can further include apertures from the lower surface to an upper surface of the first layer. Preferably, the apertures intersect the passages at the restrictions.

The body support can further comprise a sensor (e.g., a temperature sensor or a humidity sensor) that detects a parameter and produces a signal, and a controller coupled to the sensor and programmed to control the fan based on the signal. In this embodiment, multiple fans and sensors can be provided, and the controller can control the fans independent of each other to provide different air flows through different locations of the body support assembly. If desired, a user interface can be coupled to the controller to allow selection of a desired parameter of the body support assembly.

In another aspect, the invention provides a body support assembly comprising a first layer (e.g., a visco-elastic foam) having a first lower surface and a first upper surface, a second layer supporting the first layer and having a second lower surface and a second upper surface in facing relation to the first lower surface, and a third layer supporting the second layer and having a third upper surface in facing relation to the second lower surface. A plurality of first passages are defined between the first and second layers, and a plurality of second passages are defined between the second and third layers. A fan is positioned (e.g., in a cavity in the second layer) to move air between the first and second passages.

In yet another aspect, the invention provides a body support assembly comprising a first layer (e.g., a visco-elastic foam) having a lower surface, and a second layer supporting the first layer and having an upper surface in facing relation to the lower surface. The second layer has a cavity in the upper surface. An alignment fitting extends from the upper surface of the second layer in alignment with the cavity and positioned to align the first layer onto the second layer. A fan is positioned in the cavity. Preferably, the first layer includes a passage aligned with the cavity, and at least a portion of the alignment fitting is positioned in the passage to thereby align the first layer onto the second layer.

Some embodiments of the present invention provide a body support having one or more layers and having at least one cavity therein through which air or other fluid (hereinafter referred to simply as "air" for ease of description) is drawn or pushed by a fan. The fan can be located within the body support or can be located outside of the body support while also being in fluid communication with the at least one cavity. In some embodiments, the body support has a first layer with a top surface and bottom surface, a second layer adjacent the first layer top surface and having a top surface and a bottom surface, and a third layer adjacent the second layer top surface and spaced from the first layer by the second layer, wherein the top surface of the first layer and/or the bottom surface of the second layer has a non-planar surface, and/or wherein the top surface of the second layer and the bottom surface of the third layer has a non-planar surface. The non-planar surface(s) can define at least one cavity between the layers through which air is moved by the fan. The fan can move the air from the at least one cavity to a location exterior of the body support and/or can move air from a location exterior of the body support to the at least one cavity. Any of the first, second, and third layers can include visco-elastic foam. Also, any of the first, second, and third layers can comprise reticulated visco-elastic or reticulated non-visco-elastic foam.

In some embodiments of the present invention, a body support is provided that includes a first layer of foam defining a top surface and a bottom surface, and a second layer of foam positioned adjacent the top surface of the first layer and defining a top surface and a bottom surface, wherein the first and second layers of foam together define a perimeter of the body support, and wherein at least one of the top surface of the first layer and the bottom surface of the second layer is non-planar and thereby defines at least one cavity therebetween. At least one fan can be positioned within the perimeter of the body support in such embodiments, and can be in fluid communication with the at least one cavity to move air from an interior of the perimeter to an exterior of the perimeter, and/or to move air from an exterior of the perimeter to the interior of the perimeter.

Some embodiments of the present invention provide a method of controlling the temperature and/or humidity of a body support, wherein the method includes positioning first and second layers of foam in stacked relationship with one another to define at least one cavity between the layers, operating a fan to move air from the at least one cavity to a location external to the body support and/or to move air from a location external to the body support to that at least one cavity, sensing the temperature and/or humidity of the body support, sleeping surface of the body support, or environment immediately adjacent the sleeping surface, and controlling the fan to control the flow of air based on the sensed temperature and/or humidity.

Some embodiments of the present invention provide a body support assembly comprising a body support and a body support foundation, wherein the body support includes one or more layers adapted to lie directly on the foundation, and wherein the foundation includes at least one cavity therein through which air or other fluid (hereinafter referred to simply as "air" for ease of description) is moved by a fan located at least partially within the foundation. In some embodiments, the fan is in fluid communication with the at least one cavity in the foundation, as well as with one or more internal chambers within the body support. Accordingly, the fan can move the air from the internal chamber(s) within the body support to and through the at least one cavity in the foundation to a location exterior of the body support. Alternatively, in some embodiments the fan can be operated to move air from a location exterior of the body support to the at least one cavity through the at least one cavity in the foundation. Also, in some embodiments, the body support includes one or more layers of foam material, such as visco-elastic or non-visco-elastic foam, reticulated or non-reticulated foam, polyurethane foam, latex foam, any expanded polymer (e.g., expanded ethylene vinyl acetate, polypropylene, polystyrene, or polyethylene), and the like. The layer(s) of foam material can be used in conjunction with other body support materials, in some embodiments.

In some embodiments of the body support assembly of the present invention, a body support is supported on a foundation and defines at least one internal chamber. At least one fan can be positioned within the perimeter of the foundation, and is in fluid communication with the at least one internal chamber to move air from an interior of the body support to an exterior of the body support, or in some embodiments to move air from an exterior of the body support to an interior of the body support.

In some embodiments, a fan is supported in a body support foundation by a fan bracket, fitting, or other support. The fitting can be sized to channel air from the body support, toward the fan, and in some cases out of the body support foundation to control the humidity and/or temperature of the body support.

Further aspects of the present invention, together with the organization and operation thereof, will become apparent from the following detailed description of the invention when taken in conjunction with the accompanying drawings, wherein like elements have like numerals throughout the drawings.

DETAILED DESCRIPTION

Figure 1:
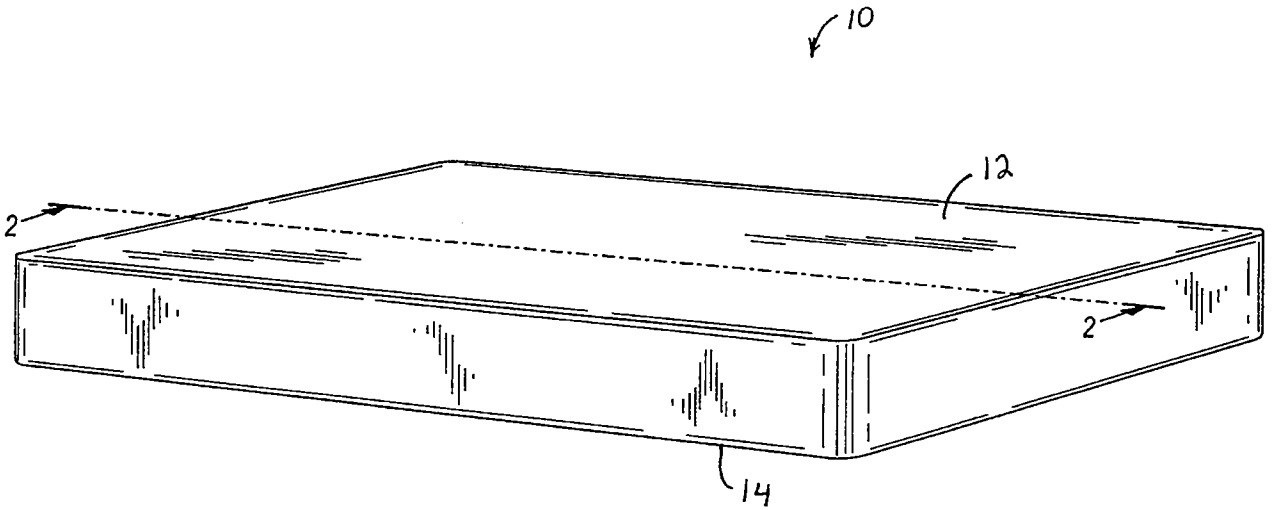
FIG. 1 is a perspective view of a body support according to an embodiment of the present invention.

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, terms such as "first", "second", and "third" are used herein and in the appended claims for purposes of description and are not intended to indicate or imply relative importance or significance unless otherwise specified. The term "first" does not necessarily refer to the top most layer, rather, it refers to the first of a plurality, without indicating a particular location or position.

The use of "including," "comprising," or "having" and variations thereof herein is meant to encompass the items listed thereafter and equivalents thereof as well as additional items. Unless limited otherwise, the terms "connected," "coupled," and variations thereof herein are used broadly and encompass direct and indirect connections and couplings. In addition, the terms "connected" and "coupled" and variations thereof are not restricted to physical or mechanical connections or couplings.

Figure 2:
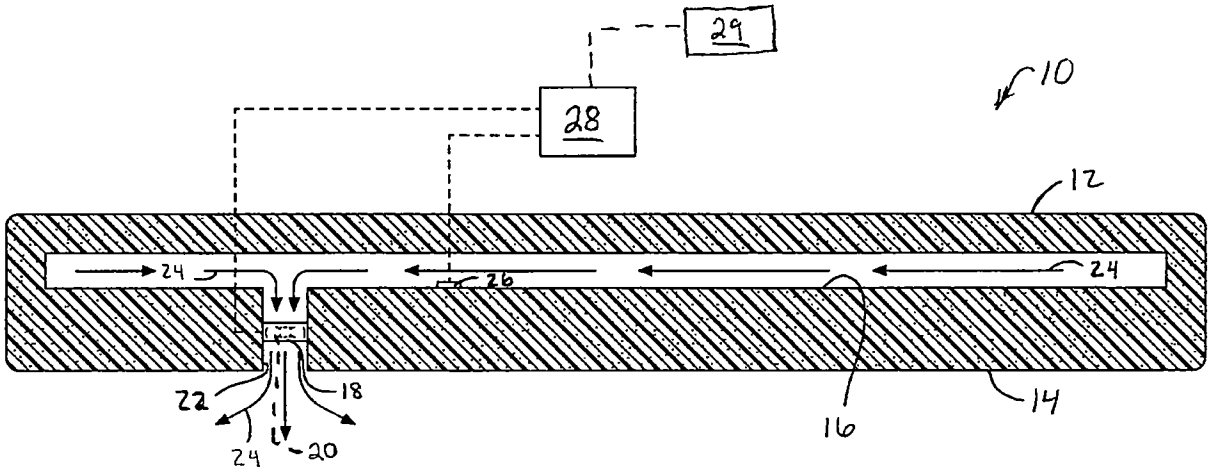
FIG. 2 is a cross-sectional schematic view of the body support of FIG. 1, taken along line 2-2 of FIG. 1.

A body support 10 according to an embodiment of the present invention is illustrated schematically in FIGS. 1 and 2. The body support 10 illustrated in FIGS. 1 and 2 is a mattress, mattress topper, overlay, sleeper sofa, or futon. It will be appreciated that the features of the body support 10 described herein are applicable to any other type of body support having any size and shape. By way of example only, these features are equally applicable to head pillows, seat cushions, seat backs, neck pillows, leg spacer pillows, and any other structure used to support or cushion any part or all of a human or animal body. Accordingly, as used herein and in the appended claims, the term "body support" is intended to refer to any and all of such structures (in addition to mattresses, mattress toppers, overlays, and futons). It should also be noted that although a number of the body supports described and illustrated herein are presented in a particular form, such as a mattress, mattress topper, overlay, futon, or pillow, any or all of the features of each such body support can be applied to any other type of body support having any other shape and size, absent description herein to the contrary.

The body support 10 illustrated in FIGS. 1 and 2 includes a top surface 12 positioned to support a user and a bottom surface 14 that can rest directly upon a frame or other support. The body support 10 can include one or more layers of foam material, although the body support 10 can also include one or more layers of other material, if desired. The material of the layers can include, for example, visco-elastic or non-visco-elastic foam, latex foam, any expanded polymer (e.g., expanded ethylene vinyl acetate, polypropylene, polystyrene, or polyethylene), and the like. In the illustrated embodiment of FIGS. 1 and 2, the body support 10 has only a single layer of foam, it being understood that this particular embodiment is not intended to limit the scope of the present invention. Rather, the body support 10 shown in FIGS. 1 and 2 is presented by way of example only.

The foam of the body support 10 shown in FIGS. 1 and 2 comprises open or closed-cell non-reticulated visco-elastic foam (sometimes referred to as "memory foam" or "low resilience foam"). In other embodiments, the foam of the body support 10 can comprise reticulated visco-elastic foam, or reticulated or non-reticulated non-visco-elastic foam. As used herein, the term "reticulated" refers to foam (visco-elastic or otherwise) having cells that are essentially skeletal. In particular, the cells of reticulated foam are each defined by a plurality of apertured windows surrounded by cell struts. The cell windows of reticulated foam can be entirely gone (leaving only the cell struts) or substantially gone. In some embodiments, the foam is considered "reticulated" if at least 50% of the windows of the cells are missing (i.e., windows having apertures therethrough, or windows that are completely missing and therefore leaving only the cell struts). Such structures can be created by destruction or other removal of cell window material, or preventing the complete formation of cell windows during the manufacturing process of the foam.

The visco-elastic nature of the foam material of the body support 10 can provide a relatively comfortable substrate for a user's body, can at least partially conform to the user's body to distribute force applied thereby, and can be selected for responsiveness to a range of temperatures generated by the body heat of a user. In the illustrated embodiment of FIGS. 1 and 2, the top and bottom surfaces 12, 14 are substantially planar. In other non-illustrated embodiments, either or both of the top and bottom surfaces 12, 14 can include one or more convolutions or other non-planar shapes.

In some embodiments, the layer of visco-elastic foam defining the body support 10 can provide a relatively soft and comfortable surface for a user's body or body portion (hereinafter referred to simply as "body" for ease of description). Coupled with the slow recovery characteristic of the visco-elastic foam, the foam of the body support 10 can also conform to a user's body, thereby distributing the force applied by the user's body upon the body support 10. In some embodiments, the visco-elastic foam of the body support has a hardness of at least about 30 N and no greater than about 175 N for desirable softness and body-conforming qualities. In other embodiments, a body support foam having a hardness of at least about 40 N and no greater than about 110 N is utilized for this purpose. In still other embodiments, a body support foam having a hardness of at least about 40 N and no greater than about 75 N is utilized. Unless otherwise specified, the hardness of a material referred to herein is measured by exerting pressure from a plate against a sample of the material having length and width dimensions of 40 cm each (defining a surface area of the sample of material), and a thickness of 5 cm to a compression of 40% of an original thickness of the material at approximately room temperature (e.g., 21-23 Degrees Celsius), wherein the 40% compression is held for a set period of time following the International Organization of Standardization (ISO) 2439 hardness measuring standard.

The foam of the body support 10 can also have a density providing a relatively high degree of material durability. The density of the foam of the body support 10 can also impact other characteristics of the foam, such as the manner in which body support 10 responds to pressure, and the feel of the foam. In some embodiments, the foam of the body support 10 has a density of no less than about 30 $kg/m^3$ and no greater than about 175 $kg/m^3$. In other embodiments, a body support foam having a density of at least about 40 $kg/m^3$ and no greater than about 130 $kg/m^3$ is utilized. In still other embodiments, a body support foam having a density of at least about 55 $kg/m^3$ and no greater than about 115 $kg/m^3$ is utilized.

The visco-elastic foam of the body support can be selected for responsiveness to any range of temperatures. However, in some embodiments, a temperature responsiveness in a range of a user's body temperatures (or in a range of temperatures to which the body support 10 is exposed by contact or proximity to a user's body resting thereon) can provide significant advantages. For example, a visco-elastic foam selected for the body support 10 can be responsive to temperature changes above at least about −5° C. In some embodiments, the visco-elastic foam selected for the body support 10 can be responsive to temperature changes within a range of at least about 10° C. In other embodiments, the visco-elastic foam selected for the body support 10 can be responsive to temperature changes within a range of at least about 15° C. As used herein and in the appended claims, a material is considered "responsive" to temperature changes if the material exhibits a change in hardness of at least 10% measured by ISO Standard 3386 through the range of temperatures between 10 and 30 degrees Celsius.

As discussed above, the body support 10 can be constructed of reticulated visco-elastic foam, rather than the non-reticulated visco-elastic foam just described. In such embodiments, airflow characteristics of the reticulated visco-elastic foam can be significantly different in such embodiments, as can the material characteristics of the reticulated visco-elastic foam. More detail regarding the features and characteristics (e.g., hardness, density, and temperature sensitivity) of reticulated foam used in some embodiments of the present invention is presented below in connection with the illustrated embodiment of FIGS. 5 and 6, the description of which applies to every embodiment described herein in which reticulated foam is used.

The body support 10 illustrated in FIGS. 1 and 2 has an internal chamber 16. The internal chamber 16 can be defined by a channel as shown in FIGS. 1 and 2, or by a void having any other shape. As used herein, the term "internal chamber" refers to any void or combination of voids in fluid communication with one another within the body support 10, and includes two or more channels extending within the body support 10 and intersecting one another, a grid of intersecting channels extending lengthwise and widthwise along the body support 10, any number of voids of the same or different shape at the same or different depths within the body support 10 and in fluid communication with one another, the spaces between and around convolutions of either or both abutting layers in the body support 10, and the like.

With reference to FIG. 2, the internal chamber 16 (shown schematically as a rectangular void, but having any other shape desired and defined at least in part by upper and lower surfaces of the internal chamber 16) extends across substantially the entire length of the body support 10. In other embodiments, the internal chamber 16 also or instead extends across substantially the entire width of the body support 10 (i.e., into and out of the plane of the page in FIG. 2). The internal chamber 16 can be one of several internal chambers 16 in the body support 10. For example, the body support can have any number of internal chambers 16 extending in the direction of the length or width of the body support 10, such as a series of parallel channels spaced from one another by elongated foam portions of the body support 10 and extending lengthwise or widthwise along the body support 10, a number of round, polygonal, or star-shaped voids located at different positions across the length and width of the body support 10, and the like. In some embodiments, the body support 10 can have a series or cluster of internal chambers 16 having any shape (e.g., round, oval, elliptical, or otherwise rotund internal chambers 16, internal chambers 16 each having a square, triangular, or other polygonal shape, elongated internal chambers 16 each having an S-shape, Z-shape, or other shape, internal chambers 16 having an irregular shape, internal chambers 16 having any combination of such shapes, and the like).

Regardless of the individual shapes of the chambers 16, the chambers 16 can each or collectively extend partially or substantially along the length and/or width of the body support 10. Also, any number or all of the internal chambers 16 can be coupled together and can thereby be in fluid communication with one another (e.g., all of the internal chambers 16 being in fluid communication with one another at intersection points, sets of internal chambers 16 being in fluid communication with one another and not being in fluid communication with other sets of internal chambers 16, and the like). In other embodiments, each of the internal chambers 16 is separate from and not in fluid communication with other internal chambers 16.

With the exception of an aperture 22 in the body support 10 described in greater detail below, the internal chamber 16 shown in the embodiment of FIGS. 1 and 2 is substantially closed on all sides by portions of the body support 10. However, in other embodiments, the internal chamber 16 is in fluid communication with one or more other apertures on the sides, top, and/or bottom of the body support 10.

In some embodiments, the internal chamber(s) 16 are created by providing at least one internal surface with a non-planar surface, such as a surface with convolutions extending partially or fully across the thickness of the internal chambers 16.

With continued reference to the illustrated embodiment of FIGS. 1 and 2, the internal chamber 16 is shown as being empty of any matter. However, in other embodiments, the internal chamber(s) 16 of the body support 10 are partially or entirely occupied by a material through which air can flow relatively freely, such as reticulated foam. Such material can provide structural support to the body support 10 at the locations of the internal chamber(s) 16, while still enabling airflow through the chamber(s) 16. This structural support can be particularly useful when the body support 10 is under pressure from a user's body—pressure that could otherwise partially or fully collapse the internal chambers 16, depending at least in part upon the shape and size of the internal chambers 16.

As best shown in FIG. 2, a fan 18 is positioned in the body support 10 between the internal chamber 16 and an aperture 22 functioning as an outlet for air moved by the fan 18 out of the internal chamber 16. The fan 18 can be retained in this position within the body support 10 by compressive force of the body support foam surrounding the fan 18, by a bracket or other fixture in the body support foam, and the like. The fan 18 can include one or more fan blades 20, as shown in phantom in FIG. 2, and can take any form desired, including without limitation an axial fan, a centrifugal fan, and the like. In some embodiments, the fan 18 is similar to a computer case fan, and can move at least about 32 cubic feet per minute of air therethrough. In other embodiments, the fan 18 can be larger or smaller than a standard computer case fan. For example, in some embodiments, the fan 18 generates airflow of at least about 5 cfm and no greater than about 200 cfm. In other embodiments, the fan 18 generates airflow of at least about 10 cfm and no greater than about 100 cfm. In still other embodiments, the fan 18 generates airflow of at least about 20 cfm and no greater than about 150 cfm.

The fan 18 can receive power through a power cord coupled to a controller 28 (described in greater detail below) as shown in FIG. 2, which in turn is connected to a source of power, such as an electrical outlet of a house, building, or other facility. Alternatively, the fan 18 can be connected directly to the source of power by a power cord.

In the illustrated embodiment, the fan 18 is positioned between the internal chamber 16 and the bottom surface 14. In other embodiments, the fan 18 can be located in other positions, such as immediately adjacent the internal chamber 16, immediately adjacent the bottom surface 14 of the body support 10, and the like.

The fan 18 is operable to move air along the internal chamber 16, through the fan, and through the aperture 22 to a location outside of the body support 10 (i.e., exterior to the body support 10). Air can be drawn into the internal chamber 16 through the material of the body support 10, through gaps between layers of the body support 10 (not shown) extending to one or more locations at the periphery of the body support 10, through one or more ports (also not shown) located on a side, top, or bottom of the body support 10, and the like. In one example, a flow of air as just described is indicated by arrows 24 in FIG. 2. It will be appreciated that the fan 18 can be located outside of the body support 10 and connected in fluid communication with the internal chamber 16 via a suitable conduit (e.g., duct, tube, pipe, or combination thereof). However, the self-contained nature of the body support 10 and fan 18 described above can present significant advantages to a user and in the manufacturing process, such as (for example) increased portability of the body support and fan 18, protection against tampering of the fan by a user or other party, and improved air movement based upon the proximity of the fan 18 to the internal chamber 16. In other embodiments, the fan 18 can be oriented to move air from a location outside of the body support 10, through the aperture 22, and into the internal chamber 16 where the air can be forced through the foam of the body support 10 and/or between layers of the body support 10. Similarly, the fan 18 can be positioned in any other air inlet location (e.g., between layers of the body support 10, at a port on the top, side, or bottom of the body support 10, and the like) to draw air into the body support 10 and to push the air through the material of the body support 10, to one or more apertures between layers of the body support 10, to one or more outlet ports on the top, side, or bottom of the body support 10, and the like.

In some embodiments, one or more sensors 26 are positioned adjacent or in the internal chamber 16 to sense any of a number of variables reflecting the operating conditions of the body support 10. These sensors 26 include without limitation temperature sensors, humidity sensors, and air pressure sensors 26. By way of example only, the single sensor 26 illustrated in FIG. 2 is a temperature sensor, although any number of temperature sensors, humidity sensors, air pressure sensors, and/or other types of sensors can instead be used. Such sensors 26 detect the temperature, humidity, air pressure, and other characteristics within the internal chamber 16, and are connected to a controller 28 that can receive the sensor information. In some embodiments, the sensor 26 is connected to the controller 28 by one or more wires extending from the sensor 26 to the controller 28. These wires can extend underneath the body support 10, and are shown only schematically in FIG. 2 as a dotted line. In other embodiments, the sensor 26 is connected to a wireless transmitter that can communicate with a wireless receiver coupled to the controller 28 in a conventional manner, thereby eliminating the need to run wires between the sensor 26 and the controller 28.

The controller 28 can take any form capable of receiving temperature, humidity, air pressure, or other internal chamber condition information and to send data representative of such information to a user interface 29 (see FIG. 2) and/or to control operation of the fan 18 based at least in part upon such data. In some embodiments, the controller 28 is a PLC or other similar controller or micro-controller, whereas in other embodiments, the controller 28 is a set of discrete logic elements or other electronics performing the same function.

In some embodiments, the controller 28 automatically adjusts the speed of the fan 18 in response to the data described above regarding one or more of the conditions in the internal chamber 16. For example, if the temperature in the internal chamber 16 is higher than a threshold temperature input to the controller 28 (e.g., upon manufacture of the body support or by a user or maintenance personnel via the user interface 29), the controller 28 can turn the fan 18 on or increase the speed of rotation of the fan blades 20 to lower the temperature in the internal chamber 16. As another example, if the pressure in the internal chamber 16 is too high (indicating that a running speed of the fan 18 is not sufficient to generate a desired level of airflow through the internal chamber 16), the controller 28 can increase the speed of rotation of the fan blades 20. The speed of the fan 18 can be increased or decreased to increase or decrease airflow through the internal chamber 16, thereby enhancing or limiting the cooling effect on the body support 10, respectively, and/or lowering or permitting recovery of humidity in and surrounding the body support 10. Also, the fan 18 can be started and stopped as needed for this same purpose.

Some embodiments of the present invention have a user interface 29 (mentioned above) coupled to the controller 28. In some embodiments, the user interface 29 contains the controller 28. In this regard, the user interface 29 can be tethered by suitable communications wiring to the controller 28, or (in embodiments in which the user interface 29 contains the controller 28) can be tethered by suitable wiring to the sensor 26. In other embodiments, the user interface 29 is provided with a wireless transmitter and receiver, and can thereby receive signals from the controller 28 or directly from the sensor 26, and can send command signals to the controller 28 or directly to a receiver connected to the fan 18 to change operation of the fan 18 as described above. Accordingly, the user interface 29 can be a wireless remote powered by one or more batteries, can communicate with one or more sensors 26 and/or can control one or more fans 18 wirelessly while receiving power through a tethered power line, or can communicate with one or more sensors 26, control one or more fan 18, and receive power through one or more wires tethering the user interface 29 to a power supply (and any necessary power transformer electronics).

The user interface 29 can include one or more buttons, knobs, dials, switches or other user actuatable controls to permit a user to adjust the operation of the fan 18 via the controller 28. In some embodiments, the user actuatable controls can be on a touch screen display (not shown) of the user interface. Alternatively, the user actuatable controls can accompany a LED, LCD, or other display, and/or any other type and number of indicators (e.g., individual LED lights or other lights). The user interface 29 can indicate to the user any or all of the temperature, humidity, and other environmental conditions detected by the sensor(s) 26 (or other information corresponding to such conditions, if the measured temperature, humidity, or other environmental condition isn't displayed), the desired temperature and/or humidity of the body support 10 set by the user (or other information corresponding to such settings, if a set temperature or set humidity isn't displayed), the operating speed of the fan 18, and other information. For example, any or all of this information can be displayed upon a display of the user interface 29 in a single screen or in multiple screens that can be navigated by a user in any conventional manner. Also or alternatively, the user interface 29 can enable the user to set temperature and/or humidity levels at which the fan 18 will turn on or at which the fan 18 will attempt to maintain the body support 10. Such input can be via a touch screen as described above, or via any of the other types of user actuatable controls also described above.

In some embodiments, one or more of the user actuatable controls can be an on/off button that permits a user to override the temperature, humidity, or other environmental conditions sensed by the sensor(s) 26 to turn the fan(s) 18 on or off manually. Also, in some embodiments, one or more of the user actuatable controls can permit the user to select a cycle time (e.g., 5 minutes) such that the controller 128 will turn the fans 18 on and off every cycle (e.g., every 5 minutes). The user interface 129 can be within reach of the user while the user is on the body support 110, thereby permitting the user to adjust settings of the body support 10 and/or otherwise control the body support via the controller 128. Other configurations and arrangements of the sensor(s) 26, controller 28 and user interface 29 are possible, and fall within the spirit and scope of the present invention.

As shown in FIG. 2 and described above, the sensor 26 in the illustrated embodiment of FIGS. 1 and 2 is positioned to detect an environmental condition within the internal chamber 16 of the body support 10. It will be appreciated that the temperature, humidity, or other environmental parameter detected by the sensor 26 may not be the same as that actually experienced by a user atop the body support 10. Accordingly, any or all of the sensors 26 employed in a body support 10 described and/or illustrated herein can be positioned elsewhere on the body support 10, such as on the top surface 12 of the body support 10, embedded in the foam of the body support 10 immediately below the top surface 12 thereof, and the like. In some embodiments, one or more sensors 26 are located at or are embedded within or beneath the top surface 12 of the body support 10 in locations where a user lying atop the body support 10 will rest (or immediately beside such locations), in order to detect a temperature of the body support 10 at such locations, thereby indicating the temperature experienced by the user. It should also be noted that the sensor(s) 26 can be located upstream and/or downstream of the fan 18, although any possible difference in air temperature and humidity between upstream and downstream locations of the fan 18 may need to be compensated for by the controller 128 in determining the environmental condition of a user on the body support 10.

In operation of the illustrated embodiment of FIGS. 1 and 2, the controller 28 receives one or more signals from the temperature sensor 26, and controls operation of the fan 18 based upon the signals. For example, the controller 28 can cause the fan to turn on, turn off, speed up, and/or slow down based upon the signals from the temperature sensor 26. As a result, air is moved along the internal chamber 16, and draws heat and/or humidity from the internal chamber 16 to the aperture 22 in the body support 10 (or is moved in a reverse direction into the internal chamber 16 from outside of the body support 10 to then exit the body support 10 through the material of the body support 10, between layers of the body support 10, and/or through one or more exit ports as described above). In doing so, heat and/or humidity is transported away from internal walls of the internal chamber 16 (including upper internal walls which can conduct heat and humidity received from the body of a user on the body support to the internal chamber) to the aperture 22 and out of the body support 10. Accordingly, operation of the fan 18 at least partially changes the heat and mass transfer mode of the body support 10 from conduction, diffusion, and natural convection, to conduction, diffusion, and forced convection.

Many of the body support materials that can be used for the body supports described herein permit some degree of airflow therethrough. Accordingly, air drawn into the body support 10 by the fan 18 can be drawn through the body support material itself, rather than and/or in addition to being drawn in by any of the other manners described herein. In this regard, the material of the body support 10 (or portion(s) of the body support 10, such as different layers or regions of the body support 10) can be selected based upon the airflow permeability of the material. For example, any portion or all of the body support 10 can be constructed of reticulated visco-elastic or reticulated non-visco-elastic foam, thereby permitting a relatively large volume of air to be drawn in through such foam and enhancing the cooling effect of such airflow. This airflow can function to transfer heat conducted to internal walls of the internal chamber 16 while also drawing cooling air through the reticulated foam. In some embodiments, at least an upper layer of the body support 10 is constructed of reticulated visco-elastic or reticulated non-visco-elastic foam, thereby enabling the fan to draw in heated air from proximate a user's body on the body support 110 as well as cooling air from locations more remote from the user's body (to cool the internal chamber 16 as described above). Accordingly, a significantly increase cooling effect can be generated by operation of the fan 18 in conjunction with reticulated foam of the body support 10. Similar cooling effects (although often of lesser strength) are possible by use of the other body support materials described herein.

Although a single temperature sensor 26 and a single fan 18 are shown in the illustrated embodiment of FIGS. 1 and 2, in other embodiments, any number of temperature sensors and/or humidity sensors 26 can be located in any number of different positions on the body support 10 (including within the body support as described above), and any number of fans 18 can be located in any number of different positions in or outside of the body support 10 as also described above. In some embodiments, two or more fans 18 are located in different positions of a body support 10 to provide different rates of cooling to different portions of a user's body. Also, in some embodiments, two or more fans 18 are located in different positions of a body support 10 to provide different rates of cooling to different individuals on the body support 10 (e.g., his and hers sides of the body support 10 having independently controllable fans 18 located in different sides of the body support 10). In such embodiments, the same or different user interfaces 29 can control different fans 18.

Also, different sensors 26 can be located in different areas of the body support (e.g., head, torso, and legs sections of the body support 10, left and right sides of the body support 10, and the like) for sensing the temperature, humidity, or other environmental condition of the body support in such areas, for automatically changing operation of one or more fans 18 corresponding to such areas of the body support 10 based upon the sensed temperature, humidity, or other environmental condition, and in some embodiments for also displaying to a user via the user interface 29.

Figure 3:
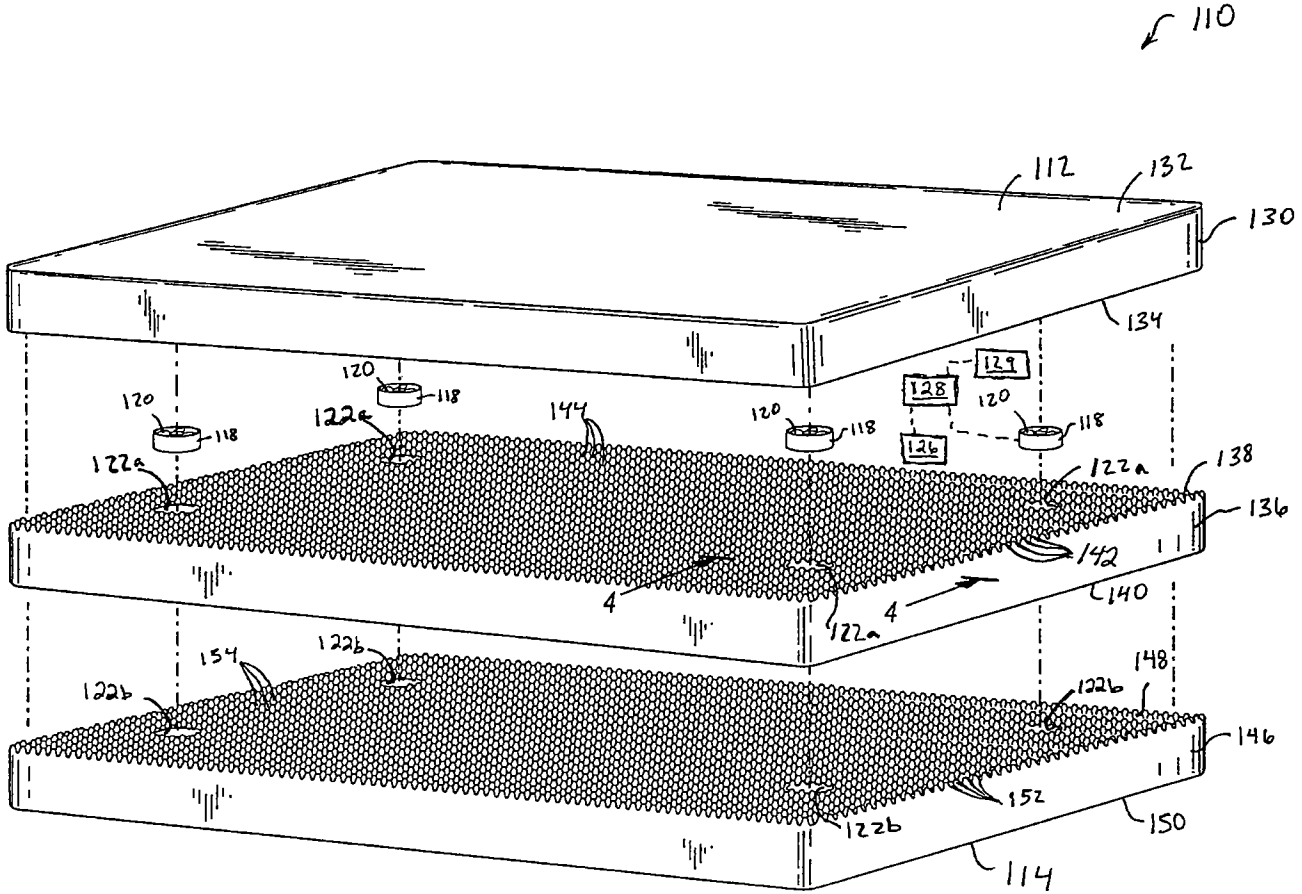
FIG. 3 is an exploded view of a body support according to another embodiment of the present invention.
Figure 4:
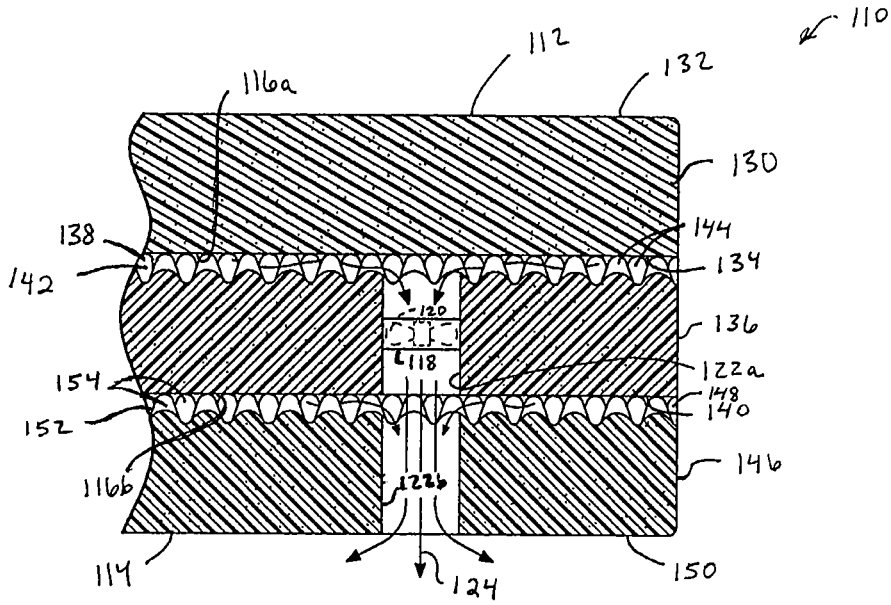
FIG. 4 is a partial cross-sectional view of the body support of FIG. 3, taken along line 4-4 of FIG. 3.

FIGS. 3 and 4 illustrate another embodiment of a body support 110 according to the present invention. This embodiment employs much of the same structure and has many of the same properties as the embodiments of the body support described above in connection with FIGS. 1 and 2. Accordingly, the following description focuses primarily upon the structure and features that are different than the embodiments described above in connection with FIGS. 1 and 2. Reference should be made to the description above in connection with FIGS. 1 and 2 for additional information regarding the structure and features, and possible alternatives to the structure and features of the body support illustrated in FIGS. 3 and 4 and described below. Structure and features of the embodiment shown in FIGS. 3 and 4 that correspond to structure and features of the embodiment of FIGS. 1 and 2 are designated hereinafter in the 100 series of reference numbers.

The body support 110 illustrated in FIGS. 3 and 4 includes a top surface 112 and a bottom surface 114 and a number of layers of foam therebetween. The illustrated body support 110 includes a top layer 130 having an upper surface 132 defining the top surface 112 of the body support 110, and a lower surface 134 opposite the upper surface 132. In other embodiments, a pillow top layer or other body support layer is positioned adjacent the upper surface 132 of the top layer 130. In the illustrated embodiment of FIGS. 3 and 4, the top layer 130 comprises open or closed-cell non-reticulated visco-elastic, but can instead comprise reticulated visco-elastic foam, or reticulated or non-reticulated non-visco-elastic foam, all of which are described above in connection with the foam of the body support 10 illustrated in FIGS. 1 and 2. In the illustrated embodiment of FIGS. 3 and 4, the upper and lower surfaces 132, 134 of the top layer 130 are substantially planar. However, in other non-illustrated embodiments, either or both of the upper and lower surfaces 132, 134 can include one or more convolutions or other non-planar shapes.

The body support 110 of FIGS. 3 and 4 also includes a middle layer 136 positioned adjacent the lower surface 134 of the top layer 130. The middle layer 136 can include an upper surface 138 positioned adjacent the lower surface 134 of the top layer 130, and a lower surface 140 spaced from the top layer 130 by the thickness of the middle layer 136. The illustrated middle layer 136 comprises non-reticulated conventional foam. However, in other embodiments, the middle layer 136 can comprise reticulated conventional foam, or reticulated or non-reticulated visco-elastic foam, the properties of which are described in greater detail above in connection with the foam material of the body support 10 of FIGS. 1 and 2.

In some embodiments, the top layer 130 can rest upon the middle layer 136 without being secured thereto. However, in other embodiments, the top and middle layers 130, 136 are secured to one another by adhesive or cohesive bonding material, by being bonded together during formation of the top and middle layers 130, 136, by tape, hook and loop fastener material, conventional fasteners, stitches extending at least partially through the top and middle layers 130, 136, or in any other suitable manner.

As also shown in FIGS. 3 and 4, the upper surface 138 of the middle layer 136 can have a non-planar shape defining a plurality of passages 142 between the visco-elastic foam top layer 130 and the middle layer 136. In some embodiments, the passages 142 can at least partially define an internal chamber 116*a* of the body support 110. As an alternative to the manner in which the internal chamber 116*a* is defined in the embodiment of FIGS. 3 and 4, the passages 142 can instead be defined between a convoluted or otherwise non-planar lower surface 134 of the visco-elastic foam top layer 130 and a substantially planar upper surface 138 of the middle layer 136, and/or between a convoluted or otherwise non-planar lower surface 134 of the visco-elastic foam top layer 130 and a convoluted or otherwise non-planar upper surface 138 of the middle layer 136. Enhanced user comfort, ventilation, and/or heat dissipation can be achieved in some embodiments by such passages 142.

In the embodiment of FIGS. 3 and 4, the convoluted upper surface 138 of the middle layer 136 defines a plurality of protrusions 144 extending toward the top layer 130. These protrusions 144 can be generally conical in shape, can be frusto-conical, or can have rounded tips as shown in FIGS. 3 and 4. As an alternative or in addition to the generally cone-shaped protrusions 144 illustrated in FIGS. 3 and 4, the upper surface 138 of the middle layer 136 can have any other type of protrusion or combinations of types of protrusions desired, including without limitation pads, bumps, pillars, and other localized protrusions, ribs, waves (e.g., having a smooth, saw tooth, or other profile), and other elongated protrusions, and the like. Also or alternatively, the upper surface 138 of the middle layer 136 can have any number and type of apertures, including without limitation recesses, dimples, blind holes, through holes, grooves, and the like, any or all of which can be defined in whole or in part by any of the types of protrusions just described.

The description of the protrusions 144 and apertures just provided apply equally to the lower surface 134 of the top layer 130 in those embodiments in which the lower surface 134 of the top layer 130 is non-planar.

The passages 142 between the top and middle layers 130, 136 of the body support 110 can be defined by protrusions 144, apertures, or any combination of protrusions 144 and apertures. Although the protrusions 144 and/or apertures need not necessarily be in any arrangement (e.g., a repeating or non-repeating pattern), in some embodiments the protrusions 144 are located on the middle layer 136 and/or top layer in such a manner. For example, the generally cone-shaped protrusions 144 of the middle layer 136 in the embodiment illustrated in FIGS. 3 and 4 are regularly spaced across the upper surface 138 of the middle layer 136. In some embodiments, the areas of the upper surface 138 located between the generally cone-shaped protrusions 144 can be recessed, and in some embodiments can cooperate with the protrusions 144 to resemble an egg-crate-shaped surface or any other surface shape desired.

Also, the protrusions 144 and/or apertures in the middle layer 136 can define passages 142 that have a constant or substantially constant height. However, in other embodiments, the protrusions 144 and/or apertures in the middle layer 136 can define passages 142 having a height that varies at different locations between the top and middle layers 130, 136. In the illustrated embodiment of FIGS. 3 and 4, the protrusions 144 are located on substantially the entire upper surface 138 of the middle layer 136. However, in other embodiments, the protrusions 144 can be located on less than all of the entire upper surface 138, such as in one or more regions of the body support 110. Similarly, apertures at least partially defining the passages 142 can be defined in one or more regions or in substantially the entire upper surface 138 of the middle layer 136 and/or lower surface 134 of the top layer 130.

As described above, passages 142 between the top and middle layers 130, 136 of the embodiment illustrated in FIGS. 3 and 4 can be defined between a substantially planar lower surface 134 of the top layer 130 and a plurality of protrusions 144 and/or apertures on the upper surface 138 of the middle layer 136. In this regard, passages 142 capable of performing ventilation and/or heat dissipating functions can be defined between the substantially planar lower surface 134 of the top layer 130 and any non-planar upper surface 138 of the middle layer 136. In other embodiments, passages 142 can be defined between a non-planar lower surface 134 of the top layer 130 and a substantially planar upper surface 138 of the middle layer 136. The non-planar lower surface 134 of the top layer 130 can have any of the protrusion and/or recess features described above in connection with the upper surface 138 of the middle layer 136 illustrated in FIGS. 3 and 4. Therefore, the description above regarding the non-planar upper surface 138 of the middle layer 136 applies equally to the lower surface 134 of the top layer 130. In still other embodiments, passages 142 can be defined between a non-planar lower surface 134 of the top layer 130 and a non-planar upper surface 138 of the middle layer 136.

The passages 142 between the lower surface 134 of the top layer 130 and the upper surface 138 of the middle layer 136 can provide enhanced ventilation and/or heat dissipation of the body support 110. The passages 142 can be particularly useful in reducing heat in regions of the body support 110.

With continued reference to the illustrated embodiment of FIGS. 3 and 4, the body support 110 includes a plurality of fans 118 located within apertures 122*a* in the middle layer 136 of the body support 110. The fans 118 can take any of the forms described above in connection with the embodiment of FIGS. 1 and 2. As also described above in connection with the embodiment of FIGS. 1 and 2, any number of fans 118 can be provided in the body support 110, can be located in any positions throughout the body support 110, and can be located outside of the body support 110 in other embodiments.

The fans 118 can be in fluid connection with the passages 142 between the top and middle layers 130, 136 to enhance ventilation and/or heat dissipation of the body support 110. In particular, the fans 118 can move heat within the body support 110 through the passages 142 by forced convection, and can move the air through the apertures 122*a* and away from the top surface 112 and top layer 130 of the body support 110. Alternatively, the fans 118 can draw air into the body support 110 and then through the material of the body support 110 and/or between layers of the body support 110 as described in greater detail above.

The body support 110 illustrated in FIGS. 3 and 4 also includes a bottom layer 146 positioned adjacent the lower surface 140 of the middle layer 136. The bottom layer 146 can include an upper surface 148 positioned adjacent the lower surface 140 of the middle layer 136, and a lower surface 150 spaced from the middle layer 136 by the thickness of the bottom layer 146. In some embodiments, the lower surface 150 defines the bottom surface 114 of the body support 110. In other embodiments, an additional layer of the body support 110 is positioned adjacent the lower surface 150 of the bottom layer 146. The illustrated bottom layer 146 comprises non-reticulated conventional foam. However, in other embodiments, the bottom layer 146 can comprise reticulated convention foam, or reticulated or non-reticulated visco-elastic foam, the properties of which are described above in connection with the foam of the body support 10 illustrated in FIGS. 1 and 2. In some embodiments, the middle layer 136 can rest upon the bottom layer 146 without being secured thereto. However, in other embodiments, the middle and bottom layers 136, 146 are secured to one another in any of the manners described above regarding the connection between the top and middle layers 130, 136.

As also shown in FIGS. 3 and 4, the upper surface 148 of the bottom layer 146 can have a non-planar shape defining a plurality of passages 152 between the foam middle layer 136 and the bottom layer 146. Airflow through some of these passages 152 is indicated by arrows 124 in FIG. 4. In some embodiments, the passages 142 can form an internal chamber 116*b*. The passages 142 can be defined between a substantially planar lower surface 140 of the foam middle layer 136 and a non-planar upper surface 148 of the bottom layer 146 and/or between a non-planar lower surface 140 of the foam middle layer 136 and a substantially planar upper surface 148 of the bottom layer 146. Enhanced user comfort, ventilation, and/or heat dissipation can be achieved in some embodiments by such passages 152.

In the embodiment of FIGS. 3 and 4, the upper surface 148 of the bottom layer 146 has a plurality of protrusions 154 extending toward the middle layer 136. The protrusions 154 can be generally conical in shape, can be frusto-conical, or can have rounded tips as shown in FIGS. 3 and 4. As an alternative or in addition to the generally cone-shaped protrusions 154 illustrated in FIGS. 3 and 4, the upper surface 148 of the bottom layer 146 can have any other type of protrusion or combinations of types of protrusions desired, including without limitation pads, bumps, pillars, and other localized protrusions, ribs, waves (e.g., having a smooth, saw tooth, or other profile), and other elongated protrusions, and the like. Also or alternatively, the upper surface 148 of the bottom layer 146 can have any number and type of apertures, including without limitation recesses, dimples, blind holes, through holes, grooves, and the like, any or all of which can be defined in whole or in part by any of the types of protrusions just described.

The passages 152 between the middle and bottom layers 136, 146 of the body support 110 can be defined by protrusions 154, apertures, or any combination of protrusions 154 and apertures. Although the protrusions 154 and/or apertures need not necessarily be in any arrangement (e.g., a repeating or non-repeating pattern) on the bottom layer 146, in some embodiments the protrusions 154 are located on the bottom layer 146 in such a manner. For example, the generally cone-shaped protrusions 154 of the bottom layer 146 in the embodiment illustrated in FIGS. 3 and 4 are regularly spaced across the upper surface 148 of the bottom layer 146. In some embodiments, the areas of the upper surface 148 located between the generally cone-shaped protrusions 154 can be recessed, and in some embodiments can cooperate with the protrusions 154 to resemble an egg-crate-shaped surface or any other surface shape desired.

Also, the protrusions 154 and/or apertures in the bottom layer 146 can define passages 152 that have a constant or substantially constant height. However, in other embodiments, the protrusions 154 and/or apertures in the bottom layer 146 can define passages 152 having a height that varies at different locations between the middle and bottom layers 136, 146. In the illustrated embodiment of FIGS. 3 and 4, the protrusions 154 are located on substantially the entire upper surface 148 of the bottom layer 146. However, in other embodiments, the protrusions 154 can be located on less than all of the entire upper surface 148, such as in one or more regions of the body support 110. Similarly, apertures at least partially defining the passages 152 can be defined in one or more regions or in substantially the entire upper surface 148 of the bottom layer 146.

As described above, passages 152 between the middle and bottom layers 136, 146 of the embodiment illustrated in FIGS. 3 and 4 can be defined between a substantially planar lower surface 140 of the middle layer 136 and a plurality of protrusions 154 and/or apertures on the upper surface 148 of the bottom layer 146. In this regard, passages 152 capable of performing ventilation and/or heat dissipating functions can be defined between the substantially planar lower surface 140 of the middle layer 136 and any non-planar upper surface 148 of the bottom layer 146. In other embodiments, passages 154 can be defined between a non-planar lower surface 140 of the middle layer 136 and a substantially planar upper surface 148 of the bottom layer 146. The non-planar lower surface 140 of the middle layer 136 can have any of the protrusion and/or recess features described above in connection with the upper surface 148 of the bottom layer 146 illustrated in FIGS. 3 and 4. Therefore, the description above regarding the non-planar upper surface 148 of the bottom layer 146 applies equally to the lower surface 140 of the middle layer 136. In still other embodiments, passages 154 can be defined between a non-planar lower surface 140 of the middle layer 136 and a non-planar upper surface 148 of the bottom layer 146.

The passages 152 between the lower surface 140 of the middle layer 136 and the upper surface 148 of the bottom layer 146 can provide enhanced ventilation and/or heat dissipation of the body support 110. Further, the plurality of fans 118 of the body support (described above) can be operated to move air through apertures 122*b* in the bottom layer 146. In some embodiments, the apertures 122*b* in the bottom layer 146 are aligned with or substantially aligned with apertures 122*a* in the middle layer 136. The fans 118 can be in fluid connection with the passages 152 described above to enhance ventilation and/or heat dissipation of the body support 110 in the same or similar manner as that described above in connection with air movement between the top and middle layers 130, 136 and within the internal chamber 16 in the embodiment of FIGS. 1 and 2. The fans 118 can move heat within the body support 110 through the passages 152 by forced convection, and can move the air through the apertures 122*b* and away from the top surface 112 and top layer 130 of the body support 110.

In the illustrated embodiment, the fans 118 are supported within the apertures 122*a* in the middle layer 136. However, in other embodiments any or all of the fans 118 (or still additional fans 118) can be supported in the apertures 122*b* of the bottom layer 146.

Tests were run to measure the difference in both resistances to heat and mass transfer in the embodiment of FIGS. 3 and 4 with the fans 118 on versus with the fans 118 off. The fans 118 remained either on or off during the tests, and no sensor or controller was used to turn the fans 118 on or off in response to heat or humidity. The resistance to heat transfer is indicated in the results table below as Rdry and the resistance to mass transfer is indicated as Rwet. As is understood in the art, lower Rdry and Rwet numbers indicate better ability to transfer heat and mass away (e.g., away from the top surface 112 of the body support 110 in the illustrated embodiment). The results are included below in Table I.

TABLE I

| | Fan On | Fan Off | % Difference |
|---|---|---|---|
| Rdry ($m^2$ * ° C./W) | 1.968 | 3.104 | −37% |
| Rwet ($m^2$ * Pa/W) | 357.109 | 460.676 | −22% |

The results in Table I indicate that the resistances to both heat and mass transfer are significantly reduced when the fans 118 are operating. Since the resistances to both heat and mass transfer are reduced, the ability of the body support 110 to shed heat and fluid mass is significantly increased. This permits the body support 110 to be cooler and/or drier, if desired by a user.

As illustrated in FIGS. 3 and 4, the plurality of fans 118 and apertures 122*a*, 122*b* can be arranged around the body support 110 to provide a desired distribution or pattern of cooling across the body support 110. For example, the fans 118 and apertures 122*a*, 122*b* can be arranged to somewhat evenly cool the body support 110. In the illustrated embodiment, four fans 118 are provided, each of which is located a corner of the body support 110. Also in the illustrated embodiment of FIGS. 3 and 4, the fans 118 are positioned off-center in a lengthwise direction of the body support 110 (i.e. laterally away from a user's torso). This arrangement of fans 118 can be desirable based upon the fact that a user's torso often produces more heat than a user's legs or head. Therefore, temperature and/or humidity can be measured and controlled in response to cooler portions of the body support 110, so that a user is not over-cooled by operation of the fans 118. In other embodiments, the fans 118 are placed near the middle of the body support 110 such that a user's torso is cooled more effectively. In the illustrated arrangement of FIGS. 3 and 4, one side of the body support 110 can be maintained a different temperature and/or have a different humidity than the other side of the body support 110 by operation of the fans 118 on one side of the body support 110 independently of the other side of the body support 110.

FIG. 3 illustrates a sensor 126 and a controller 128 coupled to one fan 118 for purposes of illustration only. As described in greater detail above in connection with the embodiment of FIGS. 1 and 2, other configurations and arrangements of the controller 128, sensors 126, and fans 118 are possible, and fall within the spirit and scope of the present invention. For example, each fan 118 can be controlled based upon signals from one or more sensors 126 (such as a thermostat or humidistat) coupled to a controller 128 to permit separate control of individual fans 118. In this example, one or more portions of the body support 110 can be maintained at a different temperature, such that a user or users can adjust the temperature of various portions of the body support 110. In other embodiments, each fan 118 can be controlled based upon signals from one or more sensors 126 coupled to the controller 128 such that the controller 128 controls operation of all the fans 118 of the body support 110 in response to the plurality of sensors 126.

In some embodiments, any or all of the fans 118 can operate in either an "on" state or an "off" state, such that the fans 118 have a single operating speed and a single non-operating speed. In some embodiments, the fans 118 can be turned on and off by the controller 128 in response to the temperature, humidity, and other environmental condition sensed by the sensor 126. In other embodiments, the fans 118 can have a plurality of operating speeds, such as high, medium, low, and one non-operating speed, such as off, and can be adjusted between such speeds in response to the sensor 126 and/or the controller 128. These various types of fans 118 and fan control can be utilized in any of the body support embodiments described and/or illustrated herein.

In some embodiments, the body support 110 is provided with a user interface 129 electrically coupled to the controller 128 and sensor(s) 126. The user interface 129 can take any of the forms, features, and capabilities described above in connection with the body support of FIGS. 1 and 2.

In the illustrated embodiment of FIGS. 3 and 4, an internal chamber 116*a* is located between the top and middle layers 130, 136, and another internal chamber 116*b* is located between the middle and bottom layers 136, 146. However, in other embodiments, the internal chamber 116*a* between the top and middle layers 130, 136 or the internal chamber 116*b* between the middle and bottom layers 136, 146 does not exist, such as in embodiments in which the confronting sides of adjacent layers 130, 136 or 136, 146 are substantially planar. In such embodiments, significant temperature and/or humidity control using one or more fans 118 as described herein is still possible.

Figure 6:
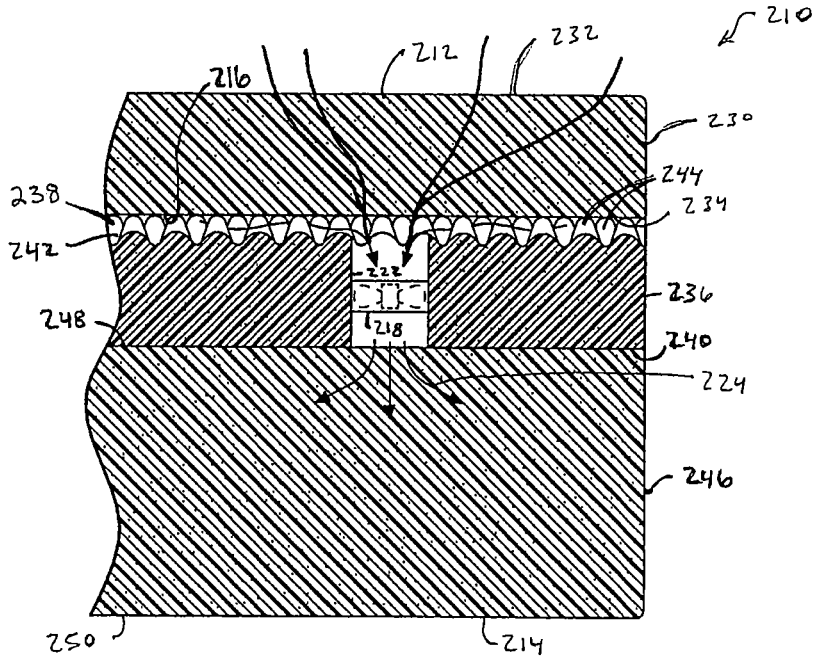
FIG. 6 is a partial cross-sectional view of the body support of FIG. 5, taken along line 6-6 of FIG. 5.
Figure 5:
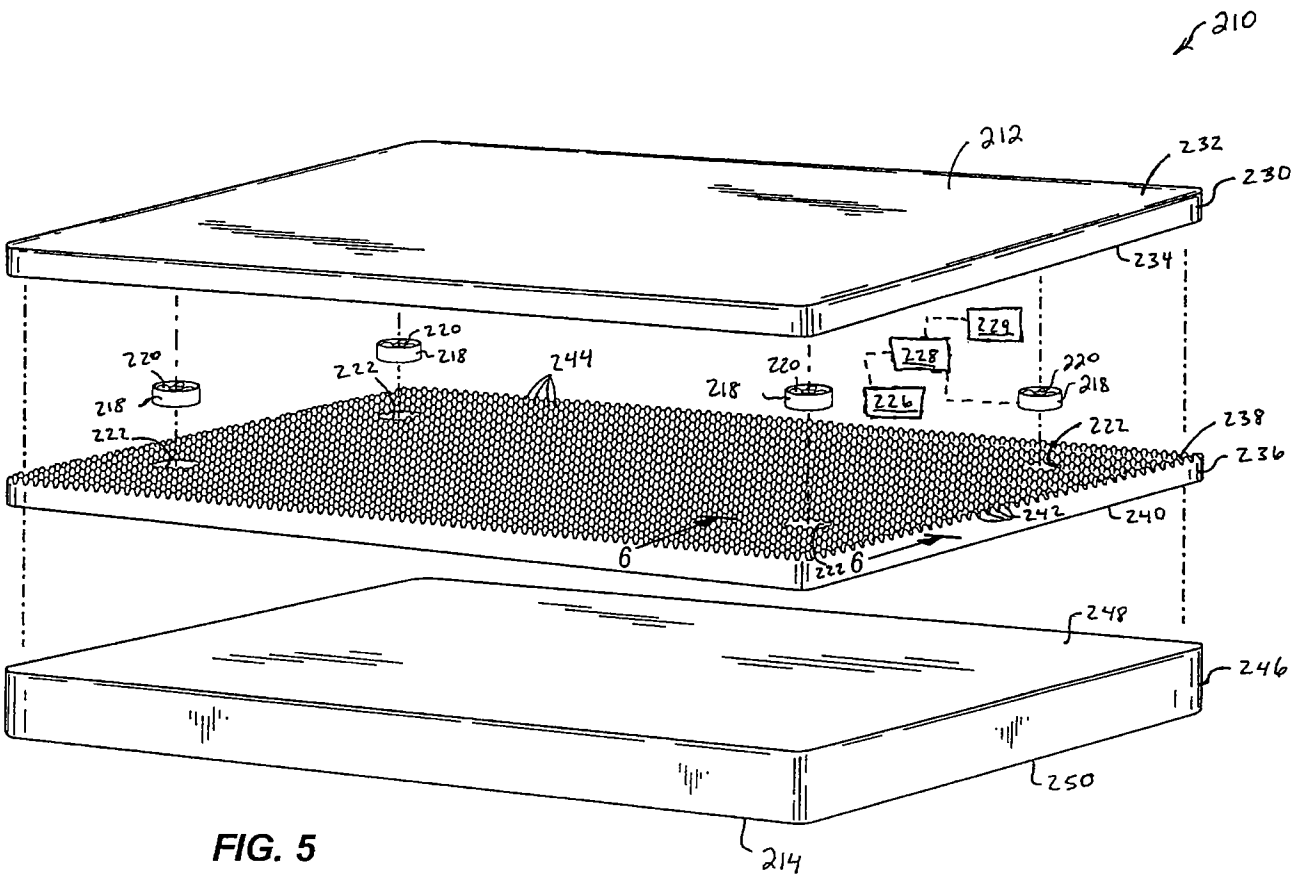
FIG. 5 is an exploded view of a body support according to another embodiment of the present invention.

FIGS. 5 and 6 illustrate another embodiment of a body support 210 according to the present invention. This embodiment employs much of the same structure and has many of the same properties as the embodiments of the body supports described above in connection with FIGS. 1-4. Accordingly, the following description focuses primarily upon the structure and features that are different than the embodiments described above in connection with FIGS. 1-4. Reference should be made to the description above in connection with FIGS. 1-4 for additional information regarding the structure and features, and possible alternatives to the structure and features of the body support illustrated in FIGS. 5 and 6 and described below. Structure and features of the embodiment shown in FIGS. 5 and 6 that correspond to structure and features of the embodiment of FIGS. 1-4 are designated hereinafter in the 200 series of reference numbers.

The body support 210 illustrated in FIGS. 5 and 6 includes a top surface 212 and a bottom surface 214 and a number of layers of foam therebetween. The illustrated body support 210 includes a top layer 230 having an upper surface 232 defining the top surface 212 of the body support 210, and a lower surface 234 opposite the upper surface 232. In other embodiments, a pillow top layer or other body support layer is positioned adjacent the upper surface 232 of the top layer 230. In the illustrated embodiment, the top layer 230 comprises reticulated visco-elastic foam. In other embodiments, the top layer 230 can comprise non-reticulated visco-elastic foam, or reticulated or non-reticulated non-visco-elastic foam. The characteristics of each of these foams (including the material properties of the reticulated and non-reticulated viscoelastic foams) are described in greater detail above in connection with the embodiments of FIGS. 1-4. The visco-elastic nature of the top layer 230 can provide a relatively comfortable substrate for a user's body, can at least partially conform to the user's body to distribute force applied thereby, and can be selected for responsiveness to a range of temperatures generated by the body heat of a user. In the illustrated embodiment, the upper and lower surfaces 232, 234 are substantially planar. In other non-illustrated embodiments, either or both of the upper and lower surfaces 232, 234 can include one or more convolutions or other non-planar shapes.

By virtue of the skeletal cellular structure of the reticulated visco-elastic foam of the top layer 230 illustrated in FIGS. 5 and 6, heat in the top layer 230 can be transferred away from a source of heat (e.g., a user's body) on the body support 210, thereby helping to prevent one or more areas of the top layer 230 from reaching an undesirably high temperature. Also, the reticulated structure of the foam in the top layer 230 enables significantly higher airflow into, out of, and through the top layer 230—a characteristic of the top layer 230 that can reduce heat in the top layer 230. At the same time, the visco-elastic nature of the foam in the top layer 230 provides desirable tactile contact and pressure responsiveness for user comfort. In this regard, the reticulated visco-elastic foam of some embodiments has a reduced hardness level, thereby providing a relatively soft and comfortable surface for a user's body. In conjunction with the slow recovery characteristic of the reticulated visco-elastic material, the top layer 230 can also at least partially conform to the user's body, thereby distributing the force applied by the user's body upon the top layer 230.

In some embodiments, the top layer 230 of reticulated visco-elastic foam has a hardness of at least about 20 N and no greater than about 150 N for desirable softness and pressure-responsive qualities. In other embodiments, a top layer 230 having a hardness of at least about 30 N and no greater than about 100 N is utilized for this purpose. In still other embodiments, a top layer 230 having a hardness of at least about 40 N and no greater than about 85 N is utilized.

The top layer 230 can also have a density providing a relatively high degree of material durability. The density of the foam in the top layer 230 can also impact other characteristics of the foam, such as the manner in which the top layer 230 responds to pressure, and the feel of the foam. In some embodiments, the top layer 230 has a density of no less than about 30 kg/m$^3$ and no greater than about 175 kg/m$^3$. In other embodiments, a top layer 230 having a density of at least about 45 kg/m$^3$ and no greater than about 130 kg/m$^3$ is utilized. In still other embodiments, a top layer 230 having a density of at least about 50 kg/m$^3$ and no greater than about 120 kg/m$^3$ is utilized.

The reticulated visco-elastic foam of the top layer 230 can be selected for responsiveness to any range of temperatures. However, in some embodiments, a temperature responsiveness in a range of a user's body temperatures (or in a range of temperatures to which the body support 210 is exposed by contact or proximity to a user's body resting thereon) can provide significant advantages. For example, a reticulated visco-elastic foam selected for the top layer 230 can be responsive to temperatures changes (as defined above) above at least −5° C. In some embodiments, the reticulated visco-elastic foam selected for the top layer 230 can be responsive to temperature changes within a range of at least about 10° C. In other embodiments, the reticulated visco-elastic foam selected for the top layer 230 can be responsive to temperature changes within a range of at least about 15° C.

The body support 210 illustrated in FIGS. 5 and 6 also has a middle layer 236 positioned adjacent the lower surface 234 of the top layer 230. The middle layer 236 can include an upper surface 238 positioned adjacent the lower surface 234 of the top layer 230, and a lower surface 240 spaced from the top layer 230 by a distance the thickness of the middle layer 236. The illustrated middle layer 236 comprises non-reticulated visco-elastic foam, and can be similar to and/or have properties similar to that of the top layer 130 of the body support 110 discussed above with regard to the embodiment of FIGS. 3 and 4. However, in other embodiments, the middle layer 236 can comprise reticulated visco-elastic foam, or reticulated or non-reticulated conventional foam, the properties of which have already been discussed above. In some embodiments, the top layer 230 can rest upon the middle layer 236 without being secured thereto. However, in other embodiments, the top and middle layers 230, 236 are secured to one another by adhesive or cohesive bonding material, by being bonded together during formation of the top and middle layers 230, 236, by tape, hook and loop fastener material, conventional fasteners, stitches extending at least partially through the top and middle layers 230, 236, or in any other suitable manner.

As also shown in FIGS. 5 and 6, the upper surface 238 of the middle layer 236 can have a non-planar shape defining a plurality of passages 242 between the reticulated visco-elastic foam top layer 230 and the middle layer 236. In some embodiments, the passages 242 can form an internal chamber 216. The passages 242 can be defined between a substantially planar lower surface 234 of the reticulated visco-elastic foam top layer 230 and a non-planar upper surface 238 of the middle layer 236 and/or between a non-planar lower surface 234 of the reticulated visco-elastic foam top layer 230 and a substantially planar upper surface 238 of the middle layer 236. Enhanced user comfort, ventilation, and/or heat dissipation can be achieved in some embodiments by such passages 242.

In the embodiment of FIGS. 5 and 6, the upper surface 238 of the middle layer 236 has a plurality of protrusions 244 extending toward the top layer 230. The protrusions 244 can be generally conical in shape, can be frusto-conical, or can have rounded tips as shown in FIGS. 5 and 6. As an alternative or in addition to the generally cone-shaped protrusions 244 illustrated in FIGS. 5 and 6, the upper surface 238 of the middle layer 236 can have any other type of protrusion or combinations of types of protrusions desired, including without limitation pads, bumps, pillars, and other localized protrusions, ribs, waves (e.g., having a smooth, saw tooth, or other profile), and other elongated protrusions, and the like. Also or alternatively, the upper surface 238 of the middle layer 236 can have any number and type of apertures, including without limitation recesses, dimples, blind holes, through holes, grooves, and the like, any or all of which can be defined in whole or in part by any of the types of protrusions just described.

The passages 242 between the top and middle layers 230, 236 of the body support 210 can be defined by protrusions 244, apertures, or any combination of protrusions 244 and apertures. Although the protrusions 244 and/or apertures need not necessarily be in any arrangement (e.g., a repeating or non-repeating pattern) on the middle layer 236, in some embodiments the protrusions 244 are located on the middle layer 236 in such a manner. For example, the generally cone-shaped protrusions 244 of the middle layer 236 in the embodiment illustrated in FIGS. 5 and 6 are regularly spaced across the upper surface 238 of the middle layer 236. In some embodiments, the areas of the upper surface 238 located between the generally cone-shaped protrusions 244 can be recessed, and in some embodiments can cooperate with the protrusions 244 to resemble an egg-crate-shaped surface or any other surface shape desired.

Also, the protrusions 244 and/or apertures in the middle layer 236 can define passages 242 that have a constant or substantially constant height. However, in other embodiments, the protrusions 244 and/or apertures in the middle layer 236 can define passages 242 having a height that varies at different locations between the top and middle layers 230, 236. In the illustrated embodiment of FIGS. 5 and 6, the protrusions 244 are located on substantially the entire upper surface 238 of the middle layer 236. However, in other embodiments, the protrusions 244 can be located on less than all of the entire upper surface 238, such as in one or more regions of the body support 210. Similarly, apertures at least partially defining the passages 242 can be defined in one or more regions or in substantially the entire upper surface 238 of the middle layer 236.

As described above, passages 242 between the top and middle layers 230, 236 of the embodiment illustrated in FIGS. 5 and 6 can be defined between a substantially planar lower surface 234 of the top layer 230 and a plurality of protrusions 244 and/or apertures on the upper surface 238 of the middle layer 236. In this regard, passages 242 capable of performing ventilation and/or heat dissipating functions can be defined between the substantially planar lower surface 234 of the top layer 230 and any non-planar upper surface 238 of the middle layer 236. In other embodiments, passages 242 can be defined between a non-planar lower surface 234 of the top layer 230 and a substantially planar upper surface 238 of the middle layer 236. The non-planar lower surface 234 of the top layer 230 in these embodiments can have any of the protrusion and/or recess features described above in connection with the upper surface 238 of the middle layer 236 illustrated in FIGS. 5 and 6. Therefore, the description above regarding the non-planar upper surface 238 of the middle layer 236 applies equally to the lower surface 234 of the top layer 230. In still other embodiments, passages 242 can be defined between a non-planar lower surface 234 of the top layer 230 and a non-planar upper surface 238 of the middle layer 236.

The passages 242 between the lower surface 234 of the top layer 230 and the upper surface 238 of the middle layer 236 can provide enhanced ventilation and/or heat dissipation of the body support 210. The passages 242 can be particularly useful in reducing heat in regions of the body support 210.

Further, as described above in connection with the embodiment of FIGS. 3 and 4, a plurality of fans 218 can be located within apertures 222 of the middle layer 236. The fans 218 can take any of the forms described above in connection with the embodiment of FIGS. 1 and 2. As also described above in connection with the embodiment of FIGS. 1 and 2, any number of fans 218 can be provided in the body support 210, can be located in any positions throughout the body support 210, and can be located outside of the body support 210 in other embodiments.

The fans 218 can be in fluid connection with the passages 242 between the top and middle layers 230, 236 to enhance ventilation and/or heat dissipation of the body support 210. In particular, the fans 218 can move heat within the body support 210 through the passages 242 by forced convection, and can move the air through the apertures 222 and away from the top surface 212 and top layer 230 of the body support 210 (i.e., along arrows 224 in FIG. 6). In some embodiments, the fans 218 can move air in a reverse direction as described in greater detail above in connection with the embodiments of FIGS. 1-4.

The body support 210 in the illustrated embodiment of FIGS. 5 and 6 also includes a bottom layer 246 positioned adjacent the lower surface 240 of the middle layer 236. The bottom layer 246 can include an upper surface 248 positioned adjacent the lower surface 240 of the middle layer 236, and a lower surface 250 spaced from the middle layer 236 by the thickness of the bottom layer 246. In some embodiments, the lower surface 250 at least partially defines the bottom surface 214 of the body support 210. In other embodiments, an additional layer of the body support 210 is positioned adjacent the lower surface 250 of the bottom layer 246. The bottom layer 246 in the illustrated embodiment of FIGS. 5 and 6 comprises reticulated non-visco-elastic foam. In other embodiments, the bottom layer 246 can comprise reticulated visco-elastic foam.

In some embodiments, the middle layer 236 can rest upon the bottom layer 246 without being secured thereto. However, in other embodiments, the middle and bottom layers 236, 246 are secured to one another by adhesive or cohesive bonding material, by being bonded together during formation of the middle and bottom layers 236, 246, by tape, hook and loop fastener material, conventional fasteners, stitches extending at least partially through the middle and bottom layers 236, 246, or any other suitable manner.

As also shown in FIGS. 5 and 6, the upper surface 248 of the bottom layer 246 can have a substantially planar shape, as can the lower surface 240 of the middle layer 236. However, since the bottom layer 246 comprises reticulated foam, the foam permits airflow therethrough due to the reticulation of the foam. The airflow through the bottom layer 246 is indicated by arrows 224 in FIG. 6. In some embodiments, the upper surface 248 of the bottom layer 246 and/or the lower surface 240 of the middle layer 236 can have a substantially non-planar shape, such as described above, to also permit air flow between the middle layer 236 and the bottom layer 246.

As shown in FIG. 6, the plurality of fans 218 can be included adjacent the bottom layer 246, and can direct air through the bottom layer 246 to enhance ventilation and/or heat dissipation of the body support 210. The fans 218 can move air by drawing air from the passages 242 and though the top layer 230 of reticulated visco-elastic foam, and directing the fluid air the apertures 222, through the bottom layer 246 and away from the top surface 212.

Tests were run to measure the difference in both resistances to heat and mass transfer in the embodiment of FIGS. 5 and 6 with the fans 218 on versus with the fans 218 off. The fans 218 remained either on or off during the tests, and no sensor or controller was used to turn the fans 218 on or off in response to heat or humidity. The resistance to heat transfer is indicated in the results table below as Rdry and the resistance to mass transfer is indicated as Rwet. As is understood in the art, lower Rdry and Rwet numbers indicate better ability to transfer heat and mass away (e.g., away from the top surface 212 of the body support 210 in the illustrated embodiment). The results are included below in Table II.

TABLE II

| | Fan On | Fan Off | % Difference |
|---|---|---|---|
| Rdry ($m^2$ * ° C./W) | 0.627 | 2.872 | −78% |
| Rwet ($m^2$ * Pa/W) | 53.719 | 295.808 | −82% |

The results in Table II indicate that the resistances to both heat and mass transfer are significantly reduced when the fans 218 are operating. Since the resistances to both heat and mass transfer are reduced, the ability of the body support 210 to shed heat and fluid mass is significantly increased. This permits the body support 210 to be cooler and/or drier, if desired by a user.

The differences in resistance to heat and mass transfer are greater in the present body support 210 than in the body support 110 of the previous illustrated embodiment. This may be the result of the use of reticulated visco-elastic foam in the top and bottom layers 230, 246 of the body support 210, which can permit greater air flow therethrough and can increase the ability of the fans 218 to draw air and fluid away from the top surface 212 and top layer 230 of the body support 210.

The fans 218 and corresponding apertures 222 can be arranged in the body support in any of the manners described above in connection with the illustrated embodiments of FIGS. 1-4.

FIG. 5 illustrates a sensor 226 and a controller 228 coupled to one fan 218 for purposes of illustration only. Other configurations and arrangements of sensors 226, fans 218, and controllers 228 are possible, including without limitation any of the configurations and arrangements of sensors, fans, and controller described above in connection with the illustrated embodiments of FIGS. 1-4. Also, operation of the fans 218 can be in any of the manners also described above in connection with the illustrated embodiments of FIGS. 1-4.

In some embodiments and as described in reference to the embodiments shown in FIGS. 1-4 above, a user interface 229 is electrically coupled to the controller 228. The user interface 229 can take any of the forms, have any of the features, and function in any of the manners described in greater detail above in connection with the illustrated embodiments of FIGS. 1-4.

FIGS. 7-9 and FIGS. 10-12 illustrate two additional embodiments of body supports 310, 410 according to the present invention. These embodiments employs much of the same structure and have many of the same properties as the embodiments of the body supports described above in connection with FIGS. 1-6. Accordingly, the following description focuses primarily upon the structure and features that are different than the embodiments described above in connection with FIGS. 1-6. Reference should be made to the description above in connection with FIGS. 1-6 for additional information regarding the structure and features, and possible alternatives to the structure and features of the body supports illustrated in FIGS. 7-12 and described below. Structure and features of the embodiments shown in FIGS. 7-12 that correspond to structure and features of the embodiment of FIGS. 1-6 are designated hereinafter in the 300 and 400 series of reference numbers, respectively.

The body supports 310, 410 illustrated in FIGS. 7-9 and 10-12 each have a top surface 312, 412 positioned to support a user and a bottom surface 314, 414 that can rest directly upon a frame or other support. The body supports 310, 410 can include one or more layers of foam material, although the body supports 310, 410 can also include one or more layers of other material, if desired and as described in greater detail above in connection with the embodiment of FIGS. 1 and 2. In the illustrated embodiments of FIGS. 7-9 and 10-12, the body supports 310, 410 each have only a single layer of foam, it being understood that these particular embodiments are not intended to limit the scope of the present invention. Rather, the body supports 310, 410 shown in FIGS. 7-9 and 10-12 are presented by way of example only.

The foam of the body supports 310, 410 shown in FIGS. 7-9 and 10-12 comprises open or closed-cell non-reticulated visco-elastic foam having any of the properties (e.g., hardness, density, and/or temperature sensitivity) described above in connection with the illustrated embodiment of FIGS. 1 and 2. In other embodiments, the foam of the body support 10 can comprise reticulated visco-elastic foam, or reticulated or non-reticulated non-visco-elastic foam also having any of the properties described above in connection with the other embodiments of the present invention.

In the illustrated embodiments of FIGS. 7-9 and 10-12, the top and bottom surfaces 312, 412 and 314, 414 are substantially planar. In other non-illustrated embodiments, either or both of the top and bottom surfaces 312, 412, 314, 414 can include one or more convolutions or other non-planar shapes.

The body supports 310, 410 illustrated in FIGS. 7-9 and 10-12 each have a number of internal chambers 316, 416. Each internal chamber 316, 416 is defined by a channel as shown in FIGS. 7-9 and 10-12. The internal chambers 316, 416 are elongated, straight, parallel to one another, and extend across the length of the body support 310, 410. However, in other embodiments, the body supports 310, 410 have fewer or more internal chambers 316, 416 having wider or narrower cross-sectional shapes, in some cases extending less than the entire length of the body supports 310, 410. Also in other embodiments, the internal chambers 316, 416 are not straight (e.g., are curved or take any path desired), are not parallel to one another, and/or extend in any other direction across the length or width of the body supports 310, 410.

The body supports 310, 410 are each provided with one or more fans 318, 418 that are mounted at an end 390, 490 of the body supports 310, 410, are located outside of the body supports 310, 410 and in fluid communication with the end 390, 490 of the body supports 310, 410 (e.g., via a suitable hose or other conduit), or are located in any other position along the internal chambers 316, 416 to draw air into and along the internal chambers 316, 416 for exhaust at an opposite end 392, 492 of the internal chambers 316, 416. In other embodiments, the exhaust of the internal chambers 316, 416 is located between the ends 390, 490, 392, 492 of the internal chambers 316, 416, such as one or more exhaust ports connecting each internal chamber 316, 416 and a location outside of the body supports 310, 410 in fluid communication. In this manner, air drawn into the internal chambers 316, 416 by the fan(s) 318, 418 need not necessarily be exhausted out an end 392, 492 of the body support 310, 410, and can instead be exhausted out a top, bottom, and/or side location of the body support 310, 410. In such cases, air can be drawn into the chambers 316, 416 in any of the manners described above, such as by a fan 318, 418 located at an exhaust port, fans 318, 418 at both ends of the body supports 310, 410, and the like. For example, in the illustrated embodiment of FIGS. 7-9 and 10-12, air can be drawn into the internal chambers 316, 416 at both ends 390, 490, 392, 492 of the body supports 310, 410 for exhaust through an exhaust port in fluid communication with each of the internal chambers 316, 416 intermediate the opposite ends of the internal chambers 316, 416.

In some embodiments of the present invention, the internal chambers 316, 416 can be in fluid communication with one another via one or more common intake or exhaust manifolds, or via one or more other manifolds located between the intake and exhaust of the internal chambers 316, 416. By way of example only, the body supports 310, 410 illustrated in FIGS. 7-9 and 10-12 each have two intake manifolds 394, 494 at one end 390, 490 of the body support 310, 410. The intake manifolds 394, 494 are in fluid communication with multiple internal chambers 316, 416. Therefore, the illustrated fans 318, 418 supply air to the manifolds 394, 494, which in turn provide a path for airflow into and along each of the internal chambers 316, 416 to and out an opposite end 392, 492 of the body support 310, 410. In some embodiments, the internal chambers 316, 416 and/or manifold(s) 394, 494 can be shaped to enhance airflow into and/or out of the internal chambers 316, 416, such as by tapering the entrance walls of each of the internal chambers 316, 416 as shown in FIGS. 7-9 and 10-12.

The illustrated body supports 310, 410 of FIGS. 7-9 and 10-12 have internal chambers 316, 416 that are shaped to enhance the flow of air from proximate the top surface 312, 412 of the body supports 310, 410 to the interior of the body support 310, 410. In particular, each of the internal chambers 316, 416 has a plurality of restrictions 396, 496 along the length thereof. The restrictions 396, 496 in the illustrated embodiment are defined by thickened areas at the top of each internal chamber 316, 416, each of which extends into and therefore restricts airflow along the internal chamber 316, 416. An aperture 398, 498 in the body support 310, 410 extends from the top surface 312, 412 to each of the restrictions 396, 496, and establishes fluid communication with the restriction 396, 496 and a location at the top surface 312, 412. Each restriction 396, 496 defines a Venturi tube which, with its corresponding aperture 398, 498, produces a suction force drawing air from the location at which the aperture 398, 498 reaches the top surface 312, 412 to the internal chamber 316, 416 when air flows through the restriction 396, 496. By this Venturi effect, heat is drawn away from those locations on the top surface 312, 412 at or proximate a user on the body support 310, 410, and is moved into the internal chambers 316, 416 away from the user (e.g., eventually to be exhausted at an end 392, 492 of the body support 310, 410 or at any other exhaust location as described above). Under the same principle, cooler air is drawn into the body support 310, 410 at other locations on the body support 310, 410 (i.e., where the user is not resting), and is drawn into and through the internal chambers 316, 416 to cool the interior of the body support 310, 410.

Figure 8:
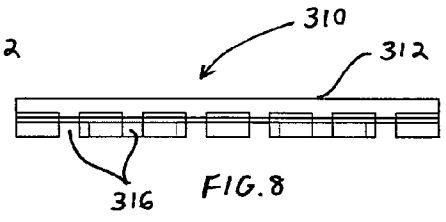
FIG. 8 is an end view of the body support of FIG. 7.
Figure 7:
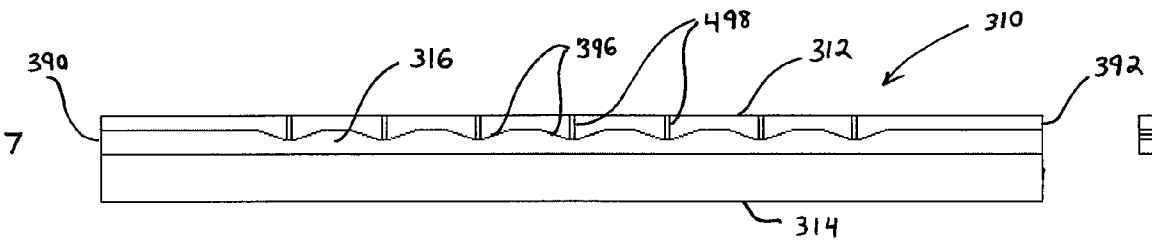
FIG. 7 is a top sectional view of a body support according to another embodiment of the present invention, taken along lines 7-7 of FIG. 9.
Figure 9:
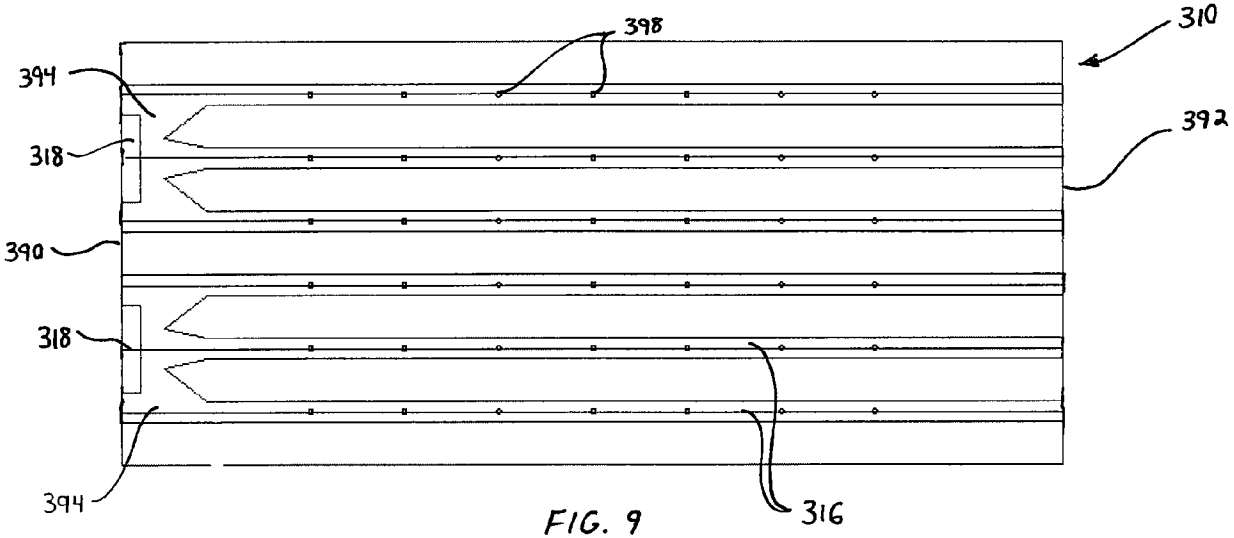
FIG. 9 is a side sectional view of the body support of FIGS. 7 and 8, taken along line 9-9 of FIG. 7.
Figure 11:
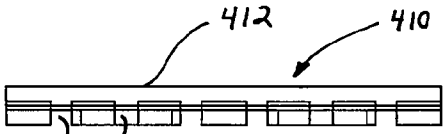
FIG. 11 is an end view of the body support of FIG. 10.
Figure 10:
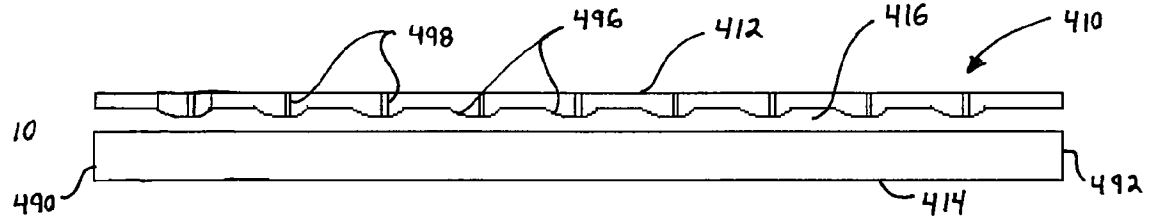
FIG. 10 is a top sectional view of a body support according to another embodiment of the present invention, taken along lines 10-10 of FIG. 12.
Figure 12:
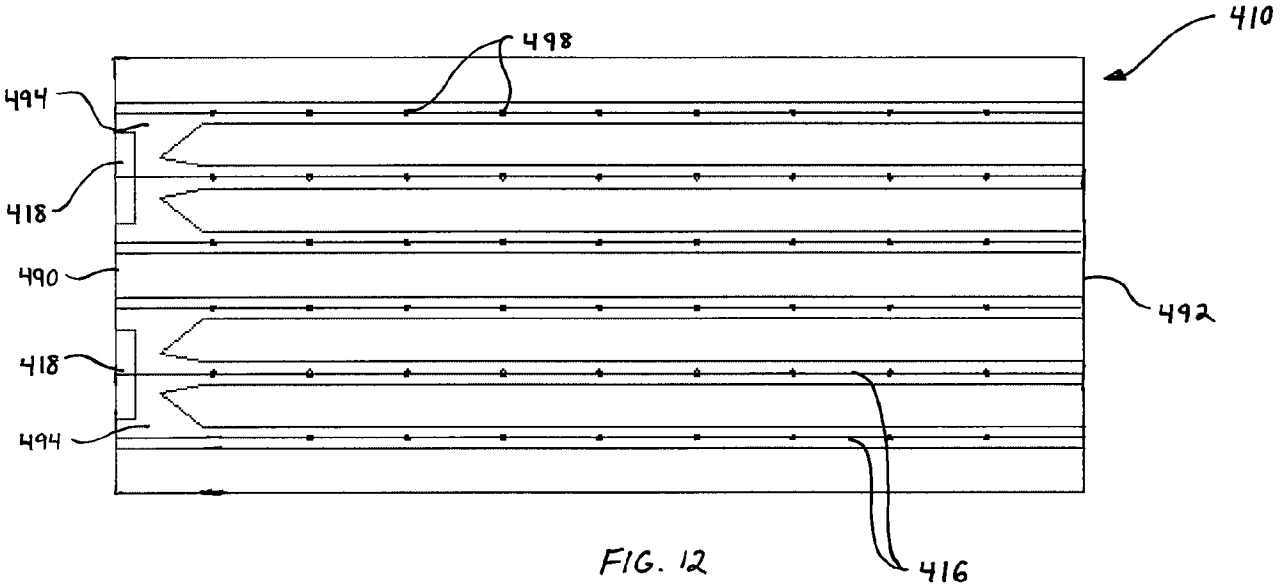
FIG. 12 is a side sectional view of the body support of FIGS. 10 and 11, taken along line 12-12 of FIG. 10.

The body supports 310, 410 illustrated in FIGS. 7-9 and 10-12 differ from one another in the shape of the restrictions 396, 496. In particular, the restrictions 396 in the body support 310 illustrated in FIGS. 7-9 are defined by substantially planar interior surfaces of the internal chambers 316, whereas the restrictions 496 in the body support 410 illustrated in FIGS. 10-12 are defined by curved interior surfaces of the internal chambers 416. In this regard, the restrictions 396, 496 can be defined by a number of faceted, non-faceted, curved, and/or planar interior surfaces or combination of such interior surfaces desired while still resulting in a Venturi tube performing the same general functions described above. All of such restrictions 396, 496 fall within the spirit and scope of the present invention.

It should also be noted that any number of restrictions 396, 496 and corresponding apertures 398, 498 in any number of internal chambers 316, 416 can be utilized, and can be located anywhere along the internal chambers 316, 416 desired. By way of example only, the restrictions 396, 496 and corresponding apertures 398, 498 can be evenly spaced along substantially the entire length or width of the body support 310, 410 based at least in part upon the location, orientation, and shape of the internal chambers 316, 416, or can be unevenly spaced therealong. As another example, such restrictions 396, 496 and corresponding apertures 398, 498 can be located in only certain areas of the body support (e.g., torso area of a user, head area of a user, one side of the body support 310, 410 to affect only the left or right side of a mattress, and the like), if desired. As yet another example, more restrictions 396, 496 and corresponding apertures 398, 498 can be located in certain areas of the body support 310, 410 (e.g., torso area of a user, head area of a user, one side of the body support 310, 410, and the like) than in other areas. Also, the restrictions 396, 496 and/or apertures 398, 498 can have the same or different sizes and/or shapes depending at least in part upon the amount of suction desired through the corresponding apertures 398, 498, and the available force of airflow through the internal chambers 316, 416 at different locations along the internal chambers 316, 416. For example, larger apertures 398, 498 and/or tighter restrictions 396, 496 may be desired in certain areas of the body support 310, 410 for enhanced airflow from the top surface 312, 412 of the body support 310, 410 in such areas.

Figure 13:
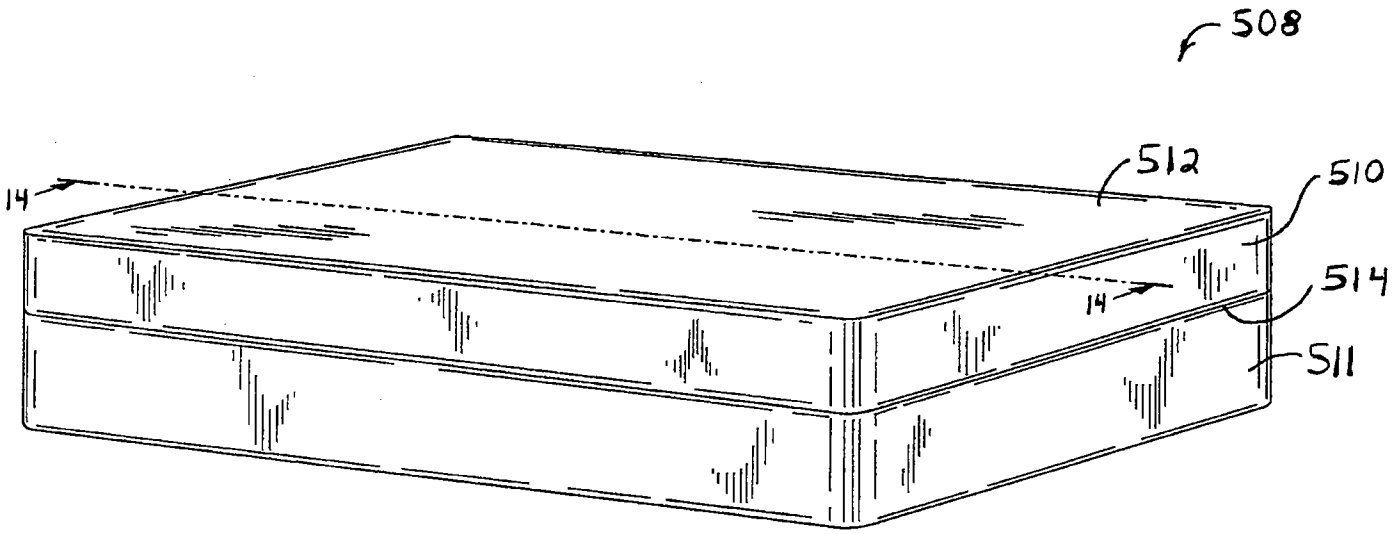
FIG. 13 is a perspective view of a body support according to an embodiment of the present invention.
Figure 14:
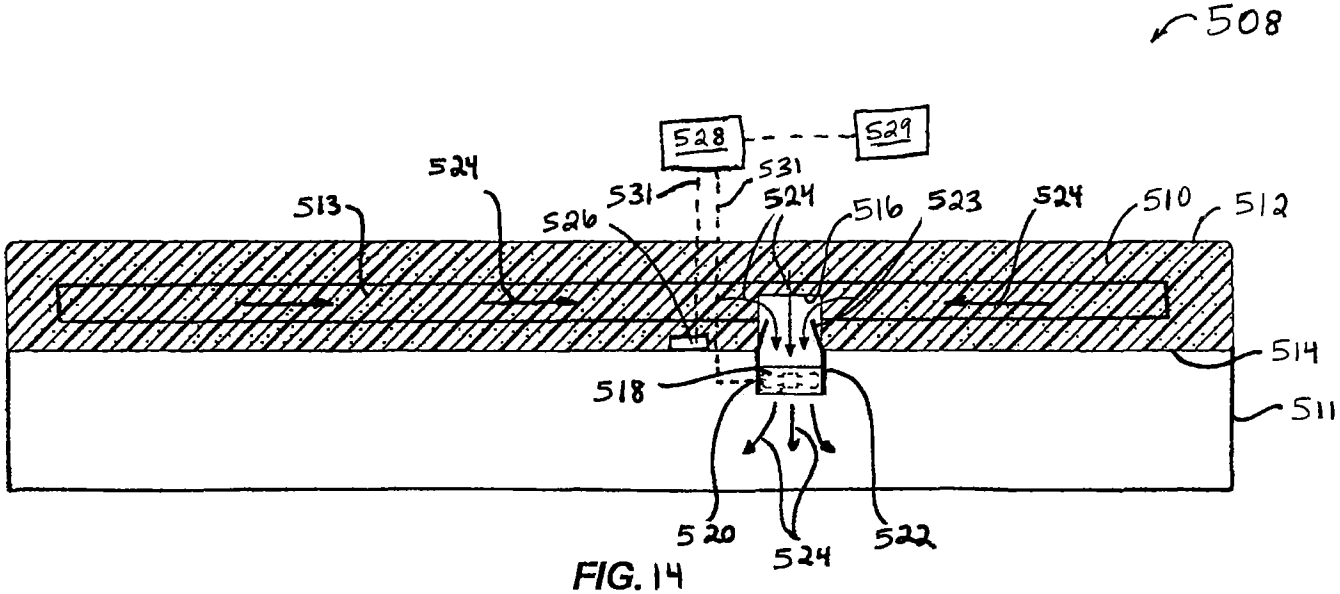
FIG. 14 is a cross-sectional schematic view of the body support of FIG. 13, taken along line 14-14 of FIG. 13.
Figure 15:
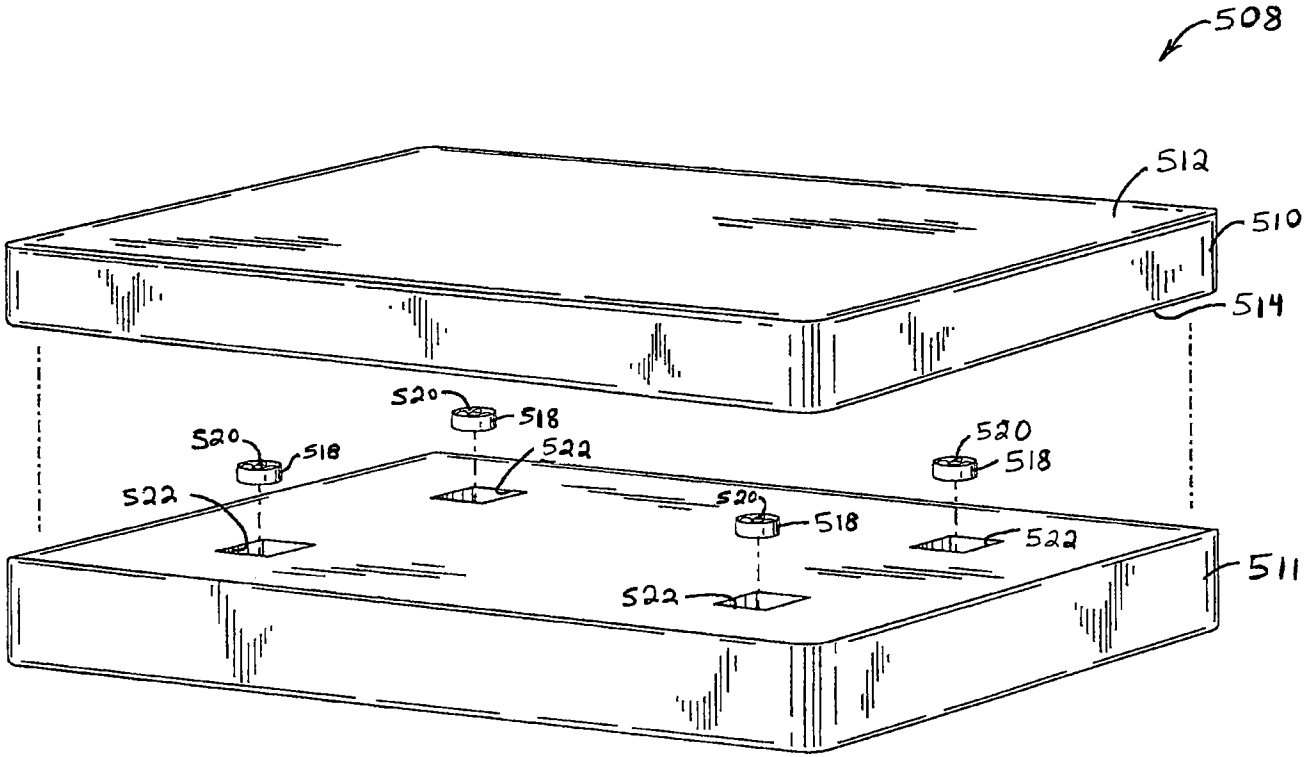
FIG. 15 is an exploded view of a body support according to an embodiment of the present invention.

FIGS. 13-15 illustrate another embodiment of a body support 510 according to the present invention. This embodiment employs much of the same structure and has many of the same properties as the embodiments of the body supports described above in connection with FIGS. 1-12. Accordingly, the following description focuses primarily upon the structure and features that are different than the embodiments described above in connection with FIGS. 1-12. Reference should be made to the description above in connection with FIGS. 1-12 for additional information regarding the structure and features, and possible alternatives to the structure and features of the body support illustrated in FIGS. 13-15 and described below. Structure and features of the embodiment shown in FIGS. 13-15 that correspond to structure and features of the embodiments of FIGS. 1-12 are designated hereinafter in the 500 series of reference numbers.

A body support assembly 508 according to an embodiment of the present invention is shown in FIGS. 13-15, and includes a body support 510 and a foundation 511. The body support 510 illustrated in FIGS. 13-15 is a mattress. However, it will be appreciated that the features of the body support 510 described herein are applicable to any other type of body support having any size and shape, and suitable for use upon a foundation as also described herein. By way of example only, these features are equally applicable to head pillows, seat cushions, seat backs, mattress toppers, mattress overlays, futons, sleeper sofas, and any other structure used to support or cushion any part or all of a human or animal body.

The body support 510 illustrated in FIGS. 13-15 includes a top surface 512 positioned to support a user and a bottom surface 514 that can rest directly upon the foundation 511. The foundation 511 can be a frame, support, or other structure suitable for supporting the weight of the body support 10 and user(s) thereon. The body support 510 can include one or more layers of foam material, although the body support 10 can also include one or more layers of other material, if desired. In the illustrated embodiment of FIGS. 13-15, the body support 510 is illustrated as only having a single layer of foam, it being understood that this particular embodiment is not intended to limit the scope of the present invention. Rather, the body support 510 shown in FIGS. 13-15 is presented by way of example only.

With reference to the illustrated embodiment of FIGS. 13-15, the top and bottom surfaces 512, 514 of the illustrated body support 510 are shown as being substantially planar. However, in other non-illustrated embodiments, either or both of the top and bottom surfaces 512, 514 can include one or more convolutions, other non-planar shapes, or combination of convolutions and other non-planar shapes. As mentioned above, the body support 510 can include visco-elastic foam. In such embodiments, the visco-elastic nature of the foam can provide, among other things, a relatively comfortable substrate for a user's body. The visco-elastic foam can at least partially conform to the user's body to distribute force applied thereby, and in some embodiments can be selected for responsiveness to a range of temperatures generated by the body heat of a user.

With continued reference to FIG. 14, the illustrated body support 510 further includes an internal chamber 513 that can be partially or fully occupied by reticulated foam (whether visco-elastic or otherwise), or that can instead be substantially empty. As will be described in greater detail below, airflow is generated through the internal chamber at times when cooling of the body support 510 is needed. The internal chamber 513 in the illustrated embodiment is only shown schematically, it being understood that the internal chamber can have any shape and size desired, and in some embodiments can be defined by a number of cavities and voids extending to various locations within the body support. In some embodiments, the body support 510 can have a series or cluster of internal chambers 513 each having any shape desired (e.g., round, oval, elliptical, or otherwise rotund internal chambers 513, internal chambers 513 each having a square, triangular, or other polygonal shape, elongated internal chambers 513 each having an S-shape, Z-shape, or other shape, internal chambers 513 having an irregular shape, internal chambers 513 having any combination of such shapes, and the like). Also, any number or all of the internal chambers 513 can be coupled together and can thereby be in fluid communication with one another (e.g., all of the internal chambers 513 being in fluid communication with one another at intersection points, sets of internal chambers 513 being in fluid communication with one another and not being in fluid communication with other sets of internal chambers 513, and the like).

In some embodiments, the internal chamber(s) 513 are created by providing at least one internal surface of the body support with a non-planar surface, such as a surface with convolutions extending partially or fully across the thickness of the internal chambers 513.

In the illustrated embodiment of FIGS. 13-15, the internal chambers 513 extend to a manifold 516 in fluid communication with the internal chambers 513. As best shown in FIG. 14, a fan 518 is adjacent the manifold 516 and is operable to direct air through the internal chambers 513. In some embodiments, the fan 518 is operable for rotation to move air toward the top surface 512 of the body support 510. However, in other embodiments, the fan 518 is operable for rotation to move air away from the top surface 512 of the body support 510. The fan 518 can include one or more fan blades 520, as shown in phantom in FIG. 14, and can take any form desired, including without limitation an axial fan, a centrifugal fan, and the like. In some embodiments, the fan 518 is similar to a computer case fan, and can move at least about 32 cubic feet per minute of air therethrough. In other embodiments, the fan 518 can be larger or smaller than a standard computer case fan. In some embodiments, one or more fans 518 can each produce a flow rate of between about 5 cubic feet per minute (cfm) and about 200 cfm. In other embodiments, one or more fans can each produce a flow rate of between about 10 cfm and about 175 cfm. In still other embodiments, one or more fans can each produce a flow rate of between about 20 cfm and about 150 cfm.

The fan 518 illustrated in FIG. 14 is positioned in an aperture 522 formed in the foundation 511 and adjacent the internal chamber 513 (i.e., that part of the internal chamber 513 defining the manifold 516, in some embodiments). The aperture 522 can function as an outlet for air moved by the fan 518 out of the internal chamber 513. In some embodiments, the fan 518 can be retained in this position within the foundation 511 by compressive force of the foundation 511 surrounding the fan 518, by a bracket, support, or other fitting (hereinafter referred to simply as a "fitting" 523), and the like. In the illustrated embodiment, the fan 518 is retained in the foundation 511 by the fitting 523. In some embodiments, the fitting 523 can extend at least partially into the internal chamber 513. In such embodiments, the fitting 523 can include a flexible material, such as a flexible polymer or other similar flexible material to accommodate some movement of the body support 510 with respect to the foundation 511. In other embodiments, the fitting 523 can be fully retained within the foundation 511. In such embodiments, the fitting 523 can include any suitable material for retaining the fan 518 within the foundation 511. In embodiments in which the fitting 523 extends upward from the foundation 511, it may be desirable to position the fitting 523 adjacent a respective cutout, recess or aperture in the body support 510, such as internal chamber 513 shown in FIG. 14. The fitting 523 and internal chamber 513 can form a duct to provide fluid flow throughout the body support assembly 508.

In the illustrated embodiment, the fan 518 is positioned below the bottom surface 514 of the body support 510. In other embodiments, the fan 518 can be located in other positions, such as immediately adjacent the internal chamber 513, immediately adjacent the bottom surface 514 of the body support 510, and the like. In still other embodiments, the fan 518 can be positioned at least partially in the internal chamber 513 of the body support 510. Positioning the fan 518 in the foundation 511 can present the advantage of at least partially isolating the user from noise and vibration caused by fan operation. Embodiments in which fan(s) 518 are positioned in the foundation 511 also permit a user to select a body support 510 and a foundation 511 separately, such that any suitable body support 510 can be supported upon the foundation 511, and any foundation can be used to support the body support 510. This permits users to purchase a particular body support 510 with the option of purchasing and using a foundation 511 having at least one fan 518.

The fan 518 in the illustrated embodiment is operable to move air along the internal chamber 513, toward and through the fan 518, and through the aperture 522 to a location outside of the body support 510 and foundation 511 (i.e., exterior to the body support 510 and foundation 511). The air can be forced through the foundation 511 and out of the sides and/or bottom of the foundation 511 in response to operation of the fan 518. By way of example only, a flow of air as just described is indicated by arrows 524 in FIG. 14. It will be appreciated that the fan 518 can be located outside of the foundation 511 and connected in fluid communication with the aperture 522 via a suitable conduit (e.g., duct, tube, pipe, or combination thereof). However, the self-contained nature of the foundation 511 and fan 518 described above can present significant advantages to a user and in the manufacturing process, such as (for example) increased portability of the foundation 511 and fan 518, ease of service without requiring disassembly of the body support assembly, protection against tampering of the fan by a user or other party, and improved air movement based upon the proximity of the fan 518 to the aperture 522. Further, in embodiments in which the fan 518 is wholly contained within the foundation 511, any suitable body support, such as body support 510, can be positioned on the foundation 511 and can benefit from the fan(s) 518 in the foundation 511. In other embodiments, the fan 518 can be oriented to move air from a location outside of the body support 510 and foundation 511, through the aperture 522, and into the internal chamber 513.

The fan 518 can receive power through a power cord coupled to a controller 528 (described in greater detail below) as shown in FIG. 14, which in turn is connected to a source of power, such as an electrical outlet of a house, building, or other facility. Alternatively, the fan 518 can be connected directly to the source of power by a power cord. In still other embodiments, the fan 518 may be battery-operated or powered by other cordless means.

In some embodiments, one or more sensors 526 are positioned proximate, adjacent, or in the internal chamber 513 to sense one or more variables reflecting the operating conditions of the body support 510. Sensors 526 can include without limitation temperature sensors, humidity sensors, and air pressure sensors 526. By way of example only, the single sensor 526 illustrated in FIG. 14 is a temperature sensor, although any number of temperature sensors, humidity sensors, air pressure sensors, and/or other types of sensors can be used. Such sensors 526 detect the temperature, humidity, air pressure, and/or other characteristics of the body support 510, and are connected to the controller 528 that can receive the sensor information. In some embodiments, the sensor 526 is connected to the controller 528 by one or more wires 531 extending from the sensor 526 to the controller 528. Wires 531 can extend beneath the body support 510 and/or foundation 511, and are shown only schematically in FIG. 14 as dotted lines. In other embodiments, the sensor 526 is connected to a wireless transmitter that can communicate with a wireless receiver coupled to the controller 528 in a conventional manner, thereby eliminating the need to run wires between the sensor 526 and the controller 528. In some embodiments, one or more sensors 526 and the controller 528 are located in the foundation 511 proximate, adjacent or in the aperture 522. In embodiments including the sensor(s) 526, controller 528 and fan(s) 518 in the foundation 511, service and warranty work may be more simple and easier to perform. In the illustrated embodiment, a single sensor 526 is located between the foundation 511 and the body support 510 proximate the internal chamber 516 and aperture 522.

The controller 528 can take any form capable of receiving temperature, humidity, air pressure, and/or other internal chamber condition information and to send data representative of such information to a user interface 529 (see FIG. 14) and/or to control operation of the fan 518 based at least in part upon such data. In some embodiments, the user interface 529 is electrically coupled to the controller 528 and sensor(s) 526. In some embodiments, the controller 528 is a PLC or other similar controller or micro-controller, whereas in other embodiments, the controller 528 is a set of discrete logic elements or other electronics performing the same function. The user interface 529 can take any of the forms, features, and capabilities described above in connection with the body supports of FIGS. 1-12.

In some embodiments, the controller 528 automatically adjusts the speed of the fan 518 in response to the data described above regarding one or more of the conditions in the internal chamber 513. For example, if the temperature in or near the internal chamber 513 is higher than a threshold temperature input to the controller 528 (e.g., upon manufacture of the body support 510 or by a user or maintenance personnel via the user interface 529), the controller 528 can turn the fan 518 on or increase the speed of rotation of the fan blades 520 to lower the temperature in the internal chamber 513. By way of example only, if the pressure in or near the internal chamber 513 is too high (indicating that a running speed of the fan 518 is not sufficient to generate a desired level of airflow through the internal chamber 513), the controller 528 can increase the speed of rotation of the fan blades 520. The speed of the fan 518 can be increased or decreased to increase or decrease airflow through the internal chamber 513, thereby enhancing or limiting the cooling effect on the body support 510, respectively, and/or lowering or permitting recovery of humidity in and surrounding the body support 510. Also, the fan 518 can be started and stopped as needed for this same purpose. In some embodiments, and depending upon the temperature of the environment surrounding the body support 510, when it is desired to increase the temperature of the body support 510, the direction of rotation of the fan blades 520 can be reversed to move heat toward the top surface 512 of the body support 510.

In some embodiments of the present invention, the user interface 529 is coupled to the controller 528. Also, in some embodiments, the user interface 529 contains the controller 528. In this regard, the user interface 529 can be tethered by suitable communications wiring to the controller 528, or (in embodiments in which the user interface 529 contains the controller 528) can be tethered by suitable wiring to the sensor 526. In other embodiments, the user interface 529 is provided with a wireless transmitter and receiver, and can thereby receive signals from the controller 528 or directly from the sensor 526, and can send command signals to the controller 528 or directly to a receiver connected to the fan 518 to change operation of the fan 518 as described above. Accordingly, the user interface 529 can be a wireless remote powered by one or more batteries, can communicate with one or more sensors 526 and/or can control one or more fans 518 wirelessly while receiving power through a tethered power line, or can communicate with one or more sensors 526, control one or more fans 18, and receive power through one or more wires tethering the user interface 529 to a power supply (and any necessary power transformer electronics).

The user interface 529 can include one or more buttons, knobs, dials, switches or other user actuatable controls to permit a user to adjust the operation of the fan 518 via the controller 528. In some embodiments, the user actuatable controls can be on a touch screen display (not shown) of the user interface. Alternatively, the user actuatable controls can accompany a LED, LCD, or other display, and/or any other type and number of indicators (e.g., individual LED lights or other lights). The user interface 529 can indicate to the user any or all of the temperature, humidity, and other environmental conditions detected by the sensor(s) 526 (or other information corresponding to such conditions, if the measured temperature, humidity, or other environmental condition is not displayed), the desired temperature and/or humidity of the body support 510 set by the user (or other information corresponding to such settings, if a set temperature or set humidity is not displayed), the operating speed of the fan 518, and other information. For example, any or all of this information can be displayed upon a display of the user interface 529 in a single screen or in multiple screens that can be navigated by a user in any conventional manner. Also or alternatively, the user interface 529 can enable the user to set temperature and/or humidity levels at which the fan 518 will turn on, or at which the fan 518 will attempt to maintain the body support 510. Such input can be via a touch screen as described above, or via any of the other types of user actuatable controls also described above.

In some embodiments, one or more of the user actuatable controls can be an on/off button that permits a user to override the temperature, humidity, or other environmental conditions sensed by the sensor(s) 526 to turn the fan(s) 518 on or off manually. Also, in some embodiments, one or more of the user actuatable controls can permit the user to select a cycle time (e.g., five minutes) such that the controller 528 will turn the fans 518 on and off every cycle (e.g., every five minutes). The user interface 529 can be within reach of the user while the user is on the body support 510, thereby permitting the user to adjust settings of the body support 510 and/or otherwise control the body support via the controller 528. Other configurations and arrangements of the sensor(s) 526, controller 528 and user interface 529 are possible, and fall within the spirit and scope of the present invention.

As shown in FIG. 14 and described above, the sensor 526 in the illustrated embodiment of FIGS. 13-15 is positioned to detect an environmental condition within the internal chamber 513 of the body support 510. It will be appreciated that the temperature, humidity, or other environmental parameter detected by the sensor 526 may not be the same as that actually experienced by a user atop the body support 510. Accordingly, any or all of sensor(s) 526 employed in a body support 510 described and/or illustrated herein can be positioned elsewhere on the body support 510, such as on the top surface 512 of the body support 510, embedded in the foam of the body support 510 immediately below the top surface 512 thereof, and the like.

In operation of the illustrated embodiment of FIGS. 13-15, the controller 528 receives one or more signals from the temperature sensor 526, and controls operation of the fan 518 based upon the signals. For example, the controller 528 can cause the fan to turn on, turn off, speed up, and/or slow down based upon the signals from the temperature sensor 526. As a result, air is moved along the internal chamber 516, and draws heat and/or humidity from the internal chamber 516 in the body support 510 and moves air into the aperture 522 in the foundation 511. In doing so, heat and/or humidity is transported away from internal walls of the internal chamber 513 (including upper internal walls which can conduct heat and humidity received from the body of a user on the body support to the internal chamber 513) to the aperture 522 and out of the foundation 511. Accordingly, operation of the fan 518 at least partially changes the heat and mass transfer mode of the body support 510 from conduction, diffusion, and natural convection, to conduction, diffusion, and forced convection.

Although a single temperature sensor 526 and a single fan 518 are shown in the illustrated embodiment of FIGS. 13-15, in other embodiments, any number of temperature sensors and/or humidity sensors 526 can be located in any number of different positions on the body support 510 (including within the body support 510 or within the foundation 511 as described above), and any number of fans 518 can be located in any number of different positions in or outside of the foundation 511 as also described above. In some embodiments, two or more fans 518 are located in different positions of the foundation 511 to provide different rates of cooling to different portions of a user's body. Also, in some embodiments, two or more fans 518 are located in different positions of a body support 510 to provide different rates of cooling to different individuals on the body support 510 (e.g., his and hers sides of the body support 510 having independently controllable fans 518 located in different sides of the foundation 511). In such embodiments, the same or different user interfaces 529 can control different fans 518.

Also, different sensors 526 can be located adjacent different areas of the body support 510 (e.g., head, torso, and legs sections of the body support 510, left and right sides of the body support 510, and the like) for sensing the temperature, humidity, or other environmental condition of the body support 510 in such areas, for automatically changing operation of one or more fans 518 corresponding to such areas of the body support 510 based upon the sensed temperature, humidity, or other environmental condition, and in some embodiments for also displaying to a user via the user interface 529.

As illustrated in FIG. 15, the plurality of fans 518 and apertures 522 can be arranged around the body support 510 and foundation 511 to provide a desired distribution or pattern of cooling across the body support 510. For example, the fans 518 and apertures 522 can be arranged to somewhat evenly cool the body support 510. In the illustrated embodiment, four fans 518 are provided, each of which is located a corner of the body support 510 and foundation 511. Also in the illustrated embodiment of FIG. 15, the fans 518 are positioned off-center in a lengthwise direction of the body support 10 (i.e. laterally away from a user's torso). This arrangement of fans 518 can be desirable based upon the fact that a user's torso often produces more heat than a user's legs or head. Therefore, temperature and/or humidity can be measured and controlled in response to cooler portions of the body support 510, so that a user is not over-cooled by operation of the fans 518. In other embodiments, the fans 518 are placed near the middle of the body support 510 such that a user's torso is cooled more effectively. In the illustrated arrangement of FIG. 15, one side of the body support 510 can be maintained a different temperature and/or have a different humidity than the other side of the body support 510 by operation of the fans 518 on one side of the body support 510 and foundation 511 independently of the other side of the body support 510 and foundation 511.

As described above, fittings 523 can retain the fans 518 in the foundation 511 (see FIG. 14). As also described in greater detail above in connection with the embodiment of FIGS. 13-15, many configurations and arrangements of the controller 528, sensors 526, and fans 518 are possible, and fall within the spirit and scope of the present invention. For example, each fan 518 can be controlled based upon signals from one or more sensors 526 (such as a thermostat or humidistat) coupled to a controller 528 to permit separate control of individual fans 518. In this example, one or more portions of the body support 510 can be maintained at a different temperature, such that a user can adjust the temperature of various portions of the body support 510. In other embodiments, each fan 518 can be controlled based upon signals from one or more sensors 526 coupled to the controller 528, such that the controller 528 controls operation of all the fans 518 in response to the plurality of sensors 526.

In some embodiments, any or all of the fans 518 can operate in either an "on" state or an "off" state, such that the fans 518 have a single operating speed and a single non-operating speed. In some embodiments, the fans 518 can be turned on and off by the controller 528 in response to the temperature, humidity, and other environmental condition(s) sensed by the sensor 526. In other embodiments, the fans 518 can have a plurality of operating speeds, such as high, medium, low, and one non-operating speed, such as off, and can be adjusted between such speeds in response to the sensor 526 and/or the controller 528. These various types of fans 518 and fan control can be utilized in any of the body support 10, 110, 210, 310, 410, 510 embodiments described and/or illustrated herein.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, although each of the illustrated embodiments shows apertures 22, 122, 222, 522 positioned to extend through a bottom surface of a layer of material in a body support 10, 110, 210, 510, it will be appreciated that any such apertures 22, 122, 222, 522 can instead extend to an exterior surface of the body support 10, 110, 210, 510 in other directions, such as through a side wall of the body support 10, 110, 210, 510, such as illustrated in FIGS. 7-9 and 10-12, or even through a top surface of the body support 10, 110, 210, 510 while still performing the same or similar functions as described herein.

Also, it should be noted that the foam selected for one or more of the layers in any of the body support embodiments described herein can be temperature-sensitive. Accordingly, the fans 18, 118, 218, 318, 418, 518 can be operated to at least partially control the firmness of the body supports 10, 110, 210, 310, 410, 510 described and illustrated herein.

Although particular constructions embodying independent aspects of the present invention have been shown and described, other alternative constructions will become apparent to those skilled in the art and are within the intended scope of the independent aspects of the present invention. Various features and advantages of the invention are set forth in the following claims.

What is claimed is:

1. A body support assembly comprising:

a first layer having a lower surface;

a second layer supporting the first layer and having an upper surface in facing relation to the lower surface, wherein at least one of the upper and lower surfaces is at least partially defined by a non-planar surface to thereby define a plurality of passages between the first and second layers; and a fan positioned to move air through the passages;

wherein the non-planar surface comprises a plurality of protrusions;

wherein the non-planar surface includes a convoluted surface.

2. A body support assembly as defined in claim 1, wherein one of the upper and lower surfaces is at least partially defined by the non-planar surface and the other of the upper and lower surfaces is substantially planar.

3. A body support assembly as defined in claim 1, wherein the first layer comprises a visco-elastic foam.

4. A body support assembly as defined in claim 1, further comprising:

a sensor that detects a parameter and produces a signal; and a controller coupled to the sensor and programmed to control the fan based on the signal.

5. A body support assembly comprising:

a first layer having a lower surface;

a second layer supporting the first layer and having an upper surface in facing relation to the lower surface, wherein at least one of the upper and lower surfaces is at least partially defined by a non-planar surface to thereby define a plurality of passages between the first and second layers; and a fan positioned to move air through the passages;

wherein at least one of the layers includes a cavity in communication with the passages, and wherein the fan is positioned in the cavity.

6. A body support assembly comprising:

a first layer having a lower surface;

a second layer supporting the first layer and having an upper surface in facing relation to the lower surface, wherein at least one of the upper and lower surfaces is at least partially defined by a non-planar surface to thereby define a plurality of passages between the first and second layers; and a fan positioned to move air through the passages;

wherein a height of the passages varies along the length of the layers to thereby define restrictions.

7. A body support assembly as defined in claim 6, wherein the assembly further includes apertures from the lower surface to an upper surface of the first layer.

8. A body support assembly as defined in claim 7, wherein the apertures intersect the passages at the restrictions.

9. A body support assembly comprising:

a first layer having a lower surface;

a second layer supporting the first layer and having an upper surface in facing relation to the lower surface, wherein at least one of the upper and lower surfaces is at least partially defined by a non-planar surface to thereby define a plurality of passages between the first and second layers; and a fan positioned to move air through the passages;

a sensor that detects a parameter and produces a signal; and a controller coupled to the sensor and programmed to control the fan based on the signal;

wherein the fan comprises multiple fans and multiple sensors, and wherein the controller can control the fans independent of each other to provide different air flow through different locations of the body support assembly.

10. A body support assembly as defined in claim 9, wherein the sensor comprises at least one of a temperature sensor and a humidity sensor.

11. A body support assembly as defined in claim 9, further comprising a user interface coupled to the controller and adapted to select a desired parameter of the body support assembly.

12. A body support assembly comprising:

a first layer having a first lower surface and a first upper surface;

a second layer supporting the first layer and having a second lower surface and a second upper surface in facing relation to the first lower surface, wherein a plurality of first passages are defined between the first and second layers;

a third layer supporting the second layer and having a third upper surface in facing relation to the second lower surface, wherein a plurality of second passages are defined between the second and third layers; and a fan positioned to move air between the first and second passages.

13. A body support assembly as claimed in claim 12, wherein the second layer includes a cavity, and wherein the fan is positioned in the cavity.

14. A body support assembly as claimed in claim 12, wherein the cavity is in communication with the first and second passages.

15. A body support assembly as defined in claim 12, wherein the first layer comprises a visco-elastic foam.

16. A body support assembly comprising:

first layer having a lower surface;

a second layer supporting the first layer and having an upper surface in facing relation to the lower surface, the second layer having a cavity in the upper surface;

an alignment fitting extending from the upper surface of the second layer in alignment with the cavity and positioned to align the first layer onto the second layer; and a fan positioned in the cavity.

17. A body support as claimed in claim 16, wherein the first layer includes a passage aligned with the cavity, wherein at least a portion of the alignment fitting is positioned in the passage to thereby align the first layer onto the second layer.

18. A body support assembly as defined in claim 16, wherein the first layer comprises a visco-elastic foam.

* * * * *